US011779070B2

(12) United States Patent
Le et al.

(10) Patent No.: US 11,779,070 B2
(45) Date of Patent: Oct. 10, 2023

(54) GARMENT WITH WAISTBAND POCKET

(71) Applicant: Under Armour, Inc., Baltimore, MD (US)

(72) Inventors: Cam Yen Le, Baltimore, MD (US); Joshua Baumer, Baltimore, MD (US); Gabriel Rodriguez, Baltimore, MD (US); Allison Douville, San Francisco, CA (US)

(73) Assignee: Under Armour, Inc., Baltimore, MD (US)

( * ) Notice: Subject to any disclaimer, the term of this patent is extended or adjusted under 35 U.S.C. 154(b) by 191 days.

(21) Appl. No.: 16/785,017

(22) Filed: Feb. 7, 2020

(65) Prior Publication Data

US 2020/0245702 A1 Aug. 6, 2020

Related U.S. Application Data

(63) Continuation of application No. 15/229,224, filed on Aug. 5, 2016, now abandoned.

(51) Int. Cl.
*A41D 27/20* (2006.01)
*A41F 9/00* (2006.01)
(Continued)

(52) U.S. Cl.
CPC ..... *A41D 27/204* (2013.01); *A41D 1/06* (2013.01); *A41D 1/08* (2013.01); *A41D 27/20* (2013.01);
(Continued)

(58) Field of Classification Search
CPC .. A41D 27/204; A41D 13/0012; A41D 27/20; A41D 27/201; A41D 27/202;
(Continued)

(56) References Cited

U.S. PATENT DOCUMENTS 1,355,044 A 10/1920 Alfred
1,920,061 A 7/1933 Carr
(Continued)

FOREIGN PATENT DOCUMENTS

DE 19850874 A1 2/2000
JP 2012101902 A 5/2012
(Continued)

OTHER PUBLICATIONS

ATHLETA Catalog, Runabout Pant, Item J, p. 37, Fall 2011, Petaluma, California.

(Continued)

*Primary Examiner* — Sally Haden
(74) *Attorney, Agent, or Firm* — Edell, Shapiro & Finnan, LLC

(57) ABSTRACT

A garment made includes at least a waist portion, a first leg portion, and a second leg portion. The waist portion further includes a pocket on the front of the garment, where the pocket is defined by at least the waist portion and a backing panel. The backing panel may be constructed from a resilient material and is reconfigurable between an empty configuration and an expanded configuration. When in the empty configuration, the backing panel may include a plurality of folded panels and may be aligned with the waist portion. When in the expanded configuration, the backing panel may be stretched to extend beyond the waist portion. The backing panel is reconfigured from the empty configuration and the expanded configuration when an object is disposed within the pocket. The pocket is sized and shaped to receive small personal items, such as smartphones, keys, money, credit cards, identification, etc.

19 Claims, 18 Drawing Sheets

(51) Int. Cl.
*A41D 1/06* (2006.01)
*A41D 1/08* (2018.01)
*A41D 7/00* (2006.01)

(52) U.S. Cl.
CPC ..... *A41F 9/00* (2013.01); *A41D 7/005* (2013.01); *A41D 27/201* (2013.01); *A41D 27/205* (2013.01)

(58) Field of Classification Search
CPC . A41D 27/205; A41B 9/14; A41F 9/00; A41F 9/02; A41F 9/025
USPC ..... 2/247, 250, 251, 252, 254
See application file for complete search history.

(56) References Cited

U.S. PATENT DOCUMENTS 2,304,235 A * 12/1942 Boots ..... A61F 5/56 2/1
2,492,862 A 12/1949 Harvey
2,501,162 A 3/1950 De
2,508,190 A * 5/1950 Previdi ..... A45F 5/00 2/253
2,537,701 A 1/1951 Previdi
2,930,046 A 3/1960 Sagner
2,988,750 A 6/1961 Reed
3,137,862 A 6/1964 Mizerak
3,206,765 A 9/1965 Sol
3,354,470 A 11/1967 Allen
3,462,764 A 8/1969 Caster
D235,937 S 7/1975 Froidh
D275,619 S 9/1984 Birring
4,513,455 A * 4/1985 Gerhardt ..... C07C 51/353 2/253
D281,540 S 12/1985 Ternstrom
D284,036 S 6/1986 Birring
D315,630 S 3/1991 Larsen
5,161,257 A 11/1992 Arensdorf et al.
D339,902 S 10/1993 Doherty
5,544,366 A 8/1996 Kato
D378,947 S 4/1997 Desmond
D382,386 S 8/1997 Malone
5,671,481 A 9/1997 Giard
5,884,338 A 3/1999 Golde
5,954,564 A 9/1999 Ganz
6,006,363 A 12/1999 Karlin
6,016,772 A 1/2000 Noyes
6,110,156 A 8/2000 Mendonca
D514,774 S 2/2006 Africa et al.
D515,282 S 2/2006 Africa
D532,958 S 12/2006 Kent
D572,430 S 7/2008 Wong
D613,037 S 4/2010 Tamartino et al.
D613,057 S 4/2010 Overton
D613,928 S 4/2010 Amartino et al.
D615,279 S 5/2010 Savage
D618,434 S 6/2010 Tamartino et al.
D618,435 S 6/2010 Tamartino et al.
D619,784 S 7/2010 Kanada et al.
D641,134 S 7/2011 Zarabi
D641,539 S 7/2011 Zarabi
D645,644 S 9/2011 Iamartino
D646,047 S 10/2011 Arensdorf
D650,589 S 12/2011 Overton et al.
8,104,654 B2 1/2012 Overton
D654,661 S 2/2012 Savage
D659,290 S 5/2012 Overton
D660,553 S 5/2012 Farina et al.
D661,872 S 6/2012 Iamartino
D662,281 S 6/2012 Iamartino
D663,075 S 7/2012 Overton
8,214,922 B2 7/2012 Moore et al.
8,220,074 B2 7/2012 Sutker
D668,434 S 10/2012 Iamartino
8,321,964 B2 12/2012 Gernes
D673,756 S 1/2013 Agnew et al.
D685,157 S 7/2013 Lamb
D686,801 S 7/2013 Farina
D687,214 S 8/2013 Farina et al.
8,555,419 B2 10/2013 Demarest et al.
D692,655 S * 11/2013 Perrea ..... A45C 13/30 D3/226
D702,018 S 4/2014 Ferraro
D702,918 S 4/2014 Radford
D722,742 S 2/2015 Abrams
8,998,052 B1 * 4/2015 Mitchell ..... A45F 3/14 224/660
9,021,615 B2 5/2015 Cockram
D740,549 S 10/2015 Nejjar
D741,045 S 10/2015 Scherr
D743,144 S 11/2015 Swan
D746,022 S 12/2015 Maier
D747,844 S 1/2016 Dawson
D747,845 S 1/2016 Pasloski
D753,896 S 4/2016 Yoo
D756,069 S 5/2016 Astin
D759,345 S 6/2016 Astin
D764,765 S * 8/2016 Diakonov ..... A45F 3/14 D2/853
D768,357 S 10/2016 White
2004/0031830 A1 2/2004 Davis
2008/0083055 A1 4/2008 Onda
2008/0163407 A1 7/2008 Gardner
2008/0189832 A1 8/2008 Oscher
2008/0190980 A1 * 8/2008 Overton ..... A45F 3/14 224/664
2009/0217440 A1 9/2009 Sutker
2009/0300818 A1 * 12/2009 Waite ..... A41D 1/14 2/76
2011/0009793 A1 1/2011 Lucero
2011/0023201 A1 2/2011 Pearl et al.
2011/0131705 A1 6/2011 Waldman et al.
2011/0219510 A1 9/2011 Nuzzo
2012/0036615 A1 2/2012 Bradstreet et al.
2012/0311758 A1 12/2012 Nicholson et al.
2013/0026203 A1 * 1/2013 Overton ..... A45C 13/30 224/576
2013/0048687 A1 * 2/2013 Do ..... A41F 9/00 224/222
2013/0305433 A1 * 11/2013 Hedrick ..... A41D 31/185 2/220
2014/0182044 A1 7/2014 Cole
2014/0196194 A1 * 7/2014 Clarke ..... A41D 1/14 2/237
2014/0276325 A1 9/2014 Turkbas
2015/0007379 A1 * 1/2015 Cockram ..... A41D 13/0015 2/236
2015/0216245 A1 8/2015 Kinsley
2015/0257459 A1 9/2015 Cockram
2016/0066637 A1 3/2016 Kim
2016/0095372 A1 4/2016 Peterson et al.
2016/0143424 A1 5/2016 Stephens et al.
2016/0338435 A1 11/2016 Aihara

FOREIGN PATENT DOCUMENTS

JP 2012171673 A 9/2012
WO 1992022463 A1 12/1992
WO 2013020083 A1 2/2013
WO 2015198060 A1 12/2015

OTHER PUBLICATIONS

ATHLETA Catalog, Organic Cotton Salamba Pant, p. 64, Fall 2011, Petaluma, California.
ATHLETA Catalog, Kickbooty Pant, p. 65, Fall 2011, Petaluma, California.
EP Communication, Application No. 17 185 194.2, dated Oct. 31, 2018, 4 pages.

* cited by examiner

GARMENT WITH WAISTBAND POCKET

CROSS REFERENCE TO RELATED APPLICATIONS

The present application is a continuation of U.S. application Ser. No. 15/229,224, filed 2 Aug. 2016 and entitled Garment with Waistband Pocket, the disclosure of which is incorporated by reference in its entirety.

FIELD OF THE INVENTION present invention relates to an article of clothing or garment. More specifically, the present invention relates to pants, shorts, and other types of bottoms that contain a pocket with a tension closure, the pocket being configured to receive objects therein.

BACKGROUND OF THE INVENTION

Garments typically are equipped with pockets that enable the wearer of the garment to store items within the pockets. Garments equipped with conventional pockets allow items to fall out of the pocket, especially when the wearer of the garment is performing athletic activity. Thus, garments equipped with conventional pockets are often equipped with fasteners that enable the conventional pockets to securely store any items placed within the pockets. In addition, athletic garments equipped with conventional pockets may cause the garment to be uncomfortable and/or create unwanted and unflattering lines or bulges in the surface of the garment. Therefore, it would be desirable to provide an article of clothing, or garment, that is equipped with a pocket that securely stores personal items without the need for fastener. It would also be desirable to provide a garment that retains personal items in a pocket while athletic activities and movements are performed by the wearer of the garment.

BRIEF SUMMARY OF THE INVENTION

An article of clothing, or garment, disclosed herein includes a storage system with a pocket in the waistband of the garment. The pocket of the garment is reconfigurable between an empty configuration and an expanded configuration. In the empty configuration, the pocket is folded to be of approximately the same height as the waistband of the garment. In the expanded configuration, the pocket is configured to securely store personal items (smartphones, keys, identification, credit cards, money, etc.) while the wearer of the garment performs activities.

BRIEF DESCRIPTION OF THE SEVERAL VIEWS OF THE DRAWINGS

Like reference numerals have been used to identify like elements throughout this disclosure.

DETAILED DESCRIPTION OF THE INVENTION

Figure 1:
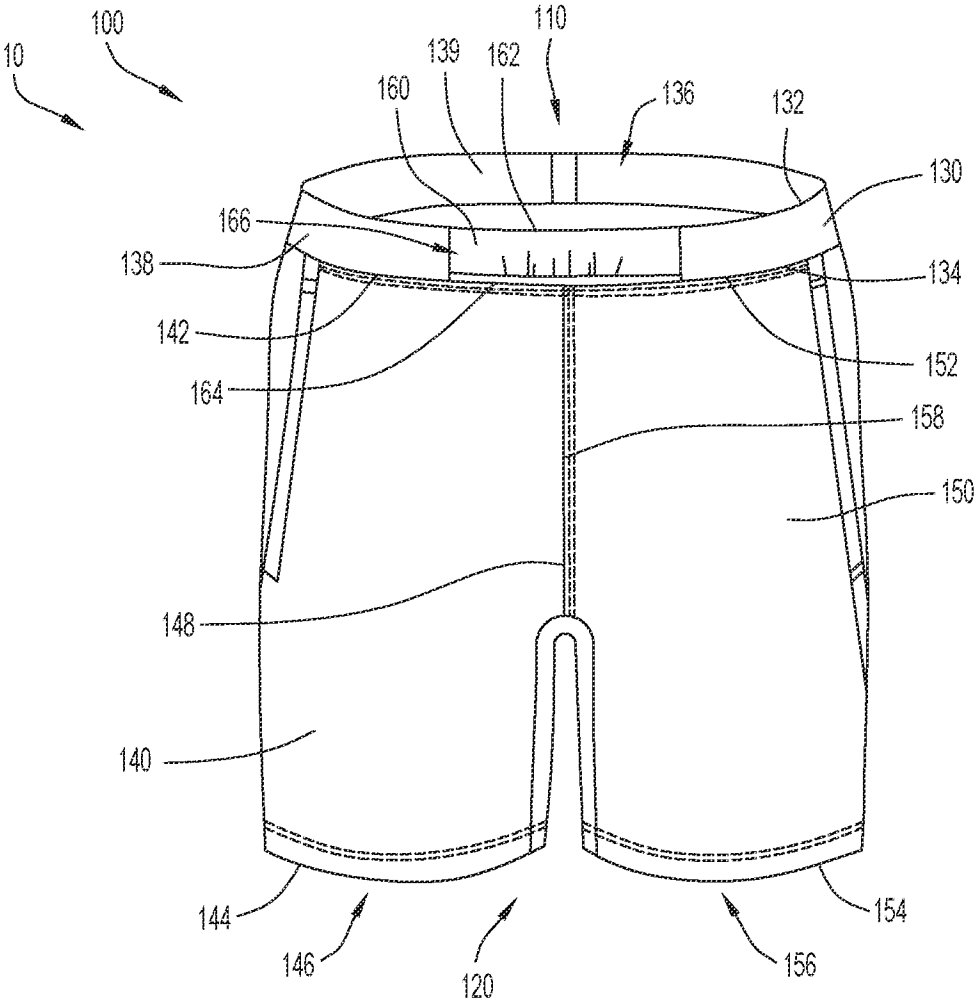
FIG. 1 illustrates a front view of a garment in accordance with a first embodiment of the present invention.

Referring to FIGS. 1, 2, 3, and 4, illustrated is a first embodiment of a garment that can be worn by a person, where the garment includes a pocket in the waistband of the garment. The embodiment of the garment illustrated is a pair of pants 10. The term pants may refer to any type of bottom typically worn by people, including, but not limited to, pants, knickers, capris, shorts, trousers, skirts, kilts, etc. The pants 10 contain a front side 100, and a rear side 200, the rear side 200 oriented opposite of the front side 100. The pants 10 further include a first (e.g., right) side 300 connecting the front side 100 to the rear side 200. The pants 10 also include a second (e.g., left) side 400 that is oriented opposite of the first side 300 and that also connects the front side 100 to the rear side 200. The pants further include a top side 110 and a bottom side 120 oriented opposite of the top side 110.

The embodiment of the pants 10 illustrated in FIGS. 1, 2, 3, and 4 may contain a waist portion 130, a first leg portion 140, and a second leg portion 150. As illustrated, the waist portion, or waistband, 130 is disposed proximate to the top 110 of the pants 10 and includes a top edge 132 and a bottom edge 134. The waist portion 130 extends around each of the sides 100, 200, 300, 400 of the pants 10 and defines opening 136 proximate to the top side 110 of the pants 10. Opening 136 is configured to receive portions of the body of the user wearing the pants 10. When worn by a user, the waist portion 130 of the pants 10 is configured to encircle or surround the user proximate to the user's waist. The waist portion 130 further includes an exterior surface 138 and an interior surface 139. When worn by a user, the interior surface 139 of the waist portion 130 contacts the portion of the body in which the waist portion encircles, while the exterior surface 138 remains exposed.

As described herein, the waist portion 130 of the pants 10 can be constructed of any suitable elastomeric fabric materials, including elastomeric fabrics that provide two-way stretch or four-way stretch characteristics so as to provide a form-fitting or compression fit against the user's body. Elastomeric fabrics can be formed from yarns, fibers and/or filaments using any suitable types of elastomeric and/or non-elastomeric components. An example of an elastomeric materials for use in forming the fabric materials for the pants are polyester-polyurethane copolymers used to form synthetic yarns, fibers or filaments and commonly referred to as spandex or elastane. Fabrics formed from yarns or fibers comprising spandex or elastane provide significant elasticity to the fabric so as to achieve a desired form or compression fit to the user's body. In one embodiment, the waist portion 130 may be constructed from a woven polyester/stretch blended fabric that contains 86% polyester and 14% elastane.

Figure 2:
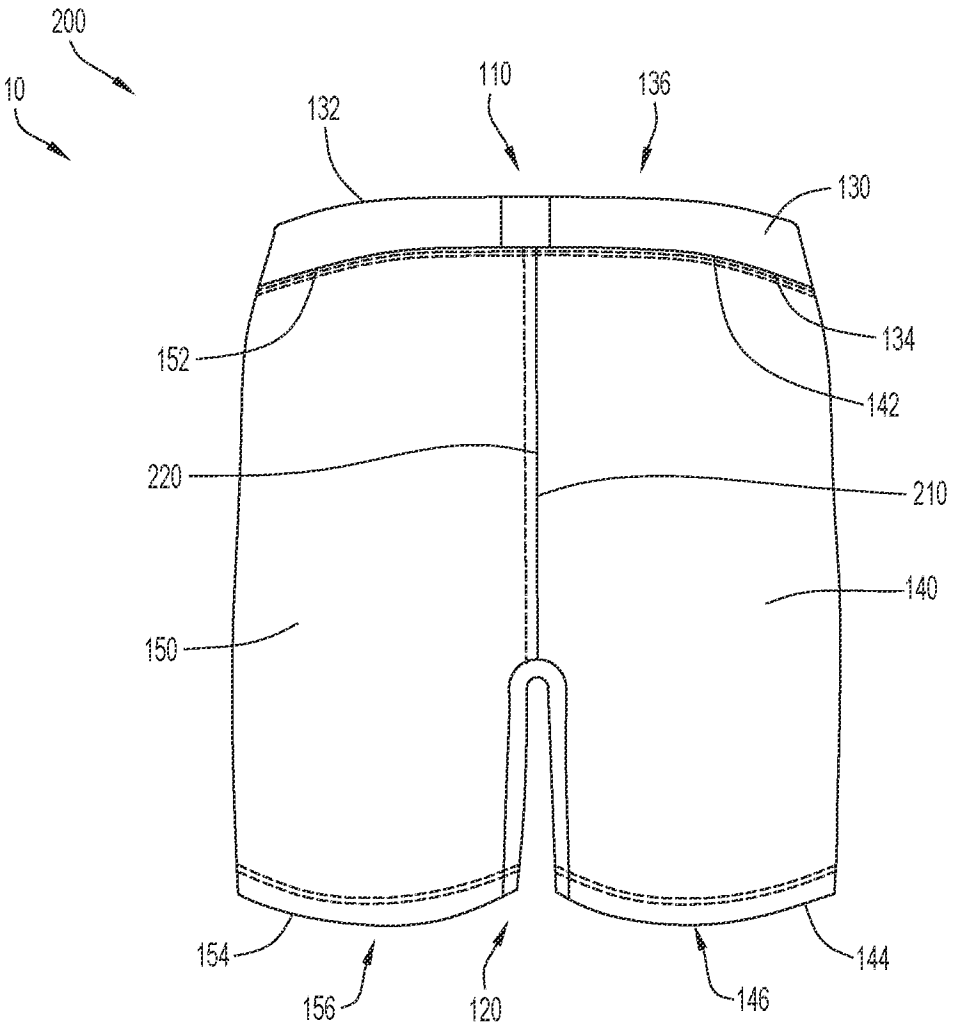
FIG. 2 illustrates a rear view of the embodiment of the garment illustrated in FIG. 1.
Figure 3:
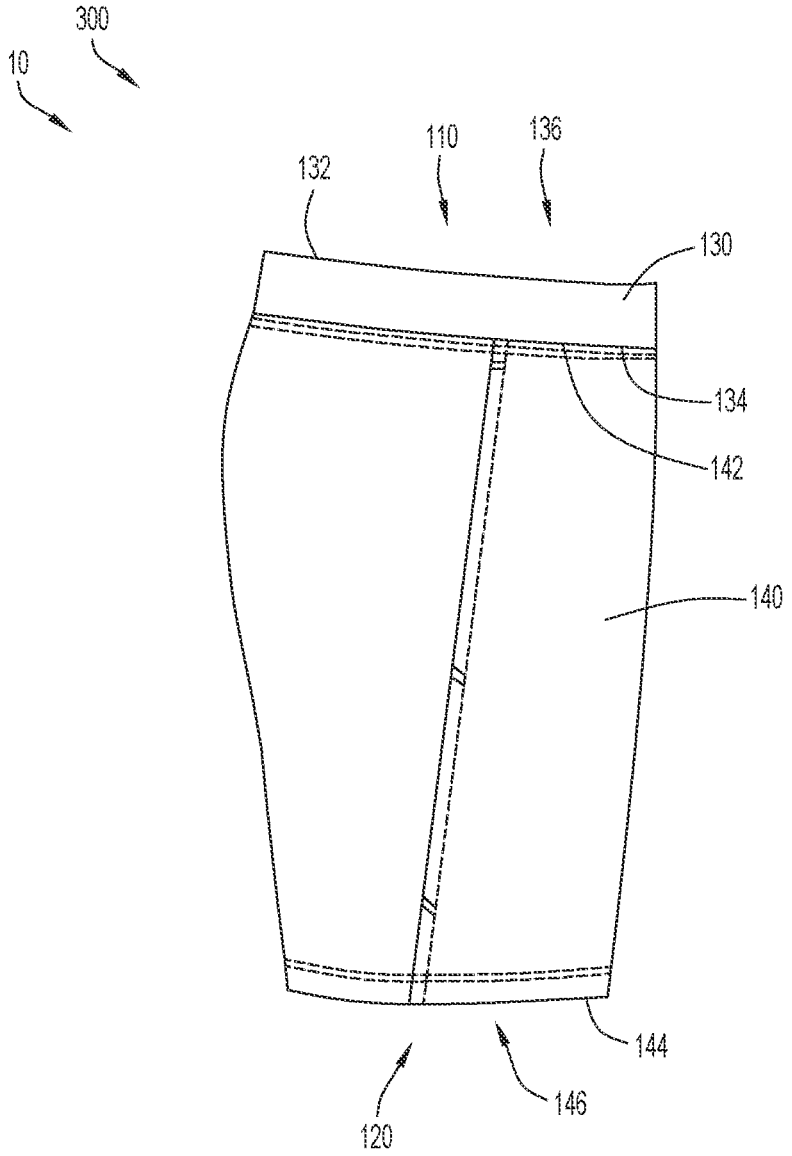
FIG. 3 illustrates a side view of a first side (e.g., right side) of the embodiment of the garment illustrated in FIG. 1.
Figure 4:
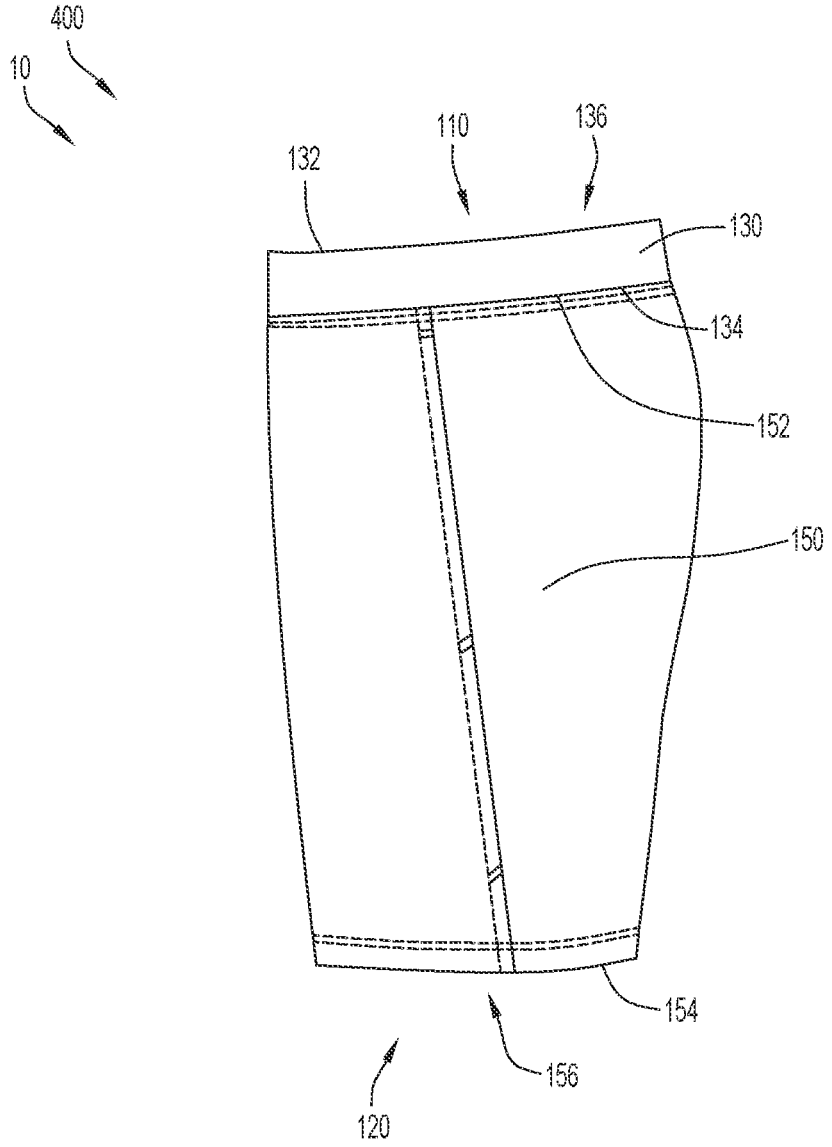
FIG. 4 illustrates a side view of a second side (e.g., left side) the embodiment of the garment illustrated in FIG. 1.

In addition, the first leg portion 140 is disposed proximate to the front side 100, rear side 200, and first side 300 of the pants 10. As illustrated in FIG. 1, the first leg portion 140 includes a top edge 142, a bottom edge 144, and a front edge 148. As illustrated in FIG. 2, the first leg portion 140 also includes a rear edge 210. The first leg portion 140 extends downwardly from the waist portion 130 towards the bottom side 120 of the pants 10, where the top edge 142 of the first leg portion 140 is coupled to a portion of the bottom edge 134 of the waist portion 130. The bottom edge 144 of the first leg portion 140 defines a first leg opening 146 that is configured to receive the first (e.g., right) leg of the user wearing the pants 10. The first leg opening 146 is disposed proximate to the bottom 120 and first side 300 of the pants 10 and surrounds or encircles at least a portion of the first leg (e.g., thigh, knee, calf, ankle, etc.) of the user wearing the pants 10. Similar to the first leg portion 140, the second leg portion 150 is disposed proximate to the front side 100, rear side 200, and second side 400 of the pants 10. As illustrated in FIG. 1, the second leg portion 150 includes a top edge 152, a bottom edge 154, and a front edge 158. As illustrated in FIG. 2, the second leg portion 150 also includes a rear edge 220. The second leg portion 150 extends downwardly from the waist portion 130 towards the bottom side 120 of the pants 10, where the top edge 152 of the second leg portion 150 is coupled to a portion of the bottom edge 134 of the waist portion 130. The bottom edge 154 of the second leg portion 150 defines a second leg opening 156 that is configured to receive the second (e.g., left) leg of the user wearing the pants 10. The second leg opening 156 is disposed proximate to the bottom 120 and second side 400 of the pants 10 and surrounds or encircles at least a portion of the second leg (e.g., thigh, knee, calf, ankle, etc.) of the user wearing the pants 10.

As illustrated in FIG. 1, the first leg portion 140 is coupled to the second leg portion 150 at a central location on the front 100 of the pants 10. More specifically, the front edge 148 of the first leg portion 140, which is vertically oriented, is coupled to the front edge 158 of the second leg portion 150, which is also vertically oriented. Similarly, as best illustrated in FIG. 2, the first leg portion 140 is coupled to the second leg portion 150 by the rear edge 210 of the first leg portion 140 being coupled to the rear edge 220 of the second leg portion 150. Similar to the front edges 148, 158, the rear edges 210, 220 of the first and second leg portion 140, 150 are vertically oriented.

The waist portion 130, first leg portion 140, and second leg portion 150 may be coupled to one another via stitching, such as, but not limited to, flatlock stitching, overlock stitching, blind stitching, etc. In addition, the waist portion 130, first leg portion 140, and second leg portion 150 may be coupled to one another by means other than stitching, such as, but not limited to, bonding, adhesives, etc. In some embodiments, the first leg portion 140 and the second leg portion 150 may be constructed from a woven polyester/stretch blended fabric that contains 86% polyester and 14% elastane, similar to that of the waist portion 130. Thus, the waist portion 130, first leg portion 140, and the second leg portion 150 are at least partially resilient/elastomeric and may be configured to stretch, deform, and take the shape of a portion of the body (e.g., the waist) of the user of the pants 10 when the user is wearing the pants 10.

As further illustrated in FIG. 1, a waist pocket 160 is disposed in or within the waist portion 130 of the pants 10 proximate to the front 100 of the pants 10. The waist pocket 160 may be centrally disposed in the waist portion 130 on the front 100 of the pants so that the waist pocket 160 is disposed equidistant from the first side 300 and the second side 400. The waist pocket 160 is further disposed on the exterior surface 138 of the waist portion 130 such that the waist pocket 160 is exposed and viewable. The waist pocket 160 has a top edge 162, a bottom edge 164, and a front surface 166. The top edge 162 of the waist pocket 160 is aligned with the top edge 132 of the waist portion 130, while the bottom edge 164 of the waist pocket 160 is aligned with the bottom edge 134 of the waist portion 130.

FIGS. 5, 6A, 6B, and 6C illustrate the waist pocket 160 of the embodiment of the pants 10 of FIGS. 1-4. As illustrated in a front view of the waist pocket 160 (e.g., viewing the side or surface of the waist pocket 160 that is on the exterior of the pants 10) in FIG. 5, the waist pocket 160 includes a first, or outer, flap 500 and a second, or inner, flap 510. The first flap 500 may include a top edge 502 and bottom edge 504. The top edge 502 may be disposed proximate to the top edge 132 of the waist portion 130 of the pants 10 such that the top edge 502 of the waist pocket 160 aligns with and/or is fixedly coupled to the top edge 132 of the waist portion 130 of the pants 10. In other words, the top edge 502 of the first flap 500 of the waist pocket 160 may form the portion of the top edge 132 of the waist portion 130 at the location where the waist pocket 160 is disposed on the waist portion 130. The bottom edge 504 may be disposed opposite of the top edge 502 such that the bottom edge 504 is disposed more proximate to the bottom edge 134 of the waist portion 130 than to the top edge 132 of the waist portion 130 of the pants 10. In addition, the sides 506, 508 of the first flap 500 may be fixedly coupled to the waist portion 130. As illustrated, the bottom edge 504 of the first flap 500 may be arcuate, or, in other words, contains a curvature 509. In other embodiments, the bottom edge 504 of the first flap 500 may include a quarter inch encased elastic with a gathering that is undercut so that, when manipulated, the bottom edge 504 of the first flap 500 returns to its position proximate to the bottom edge 164 of the waist pocket 160.

Figure 5:
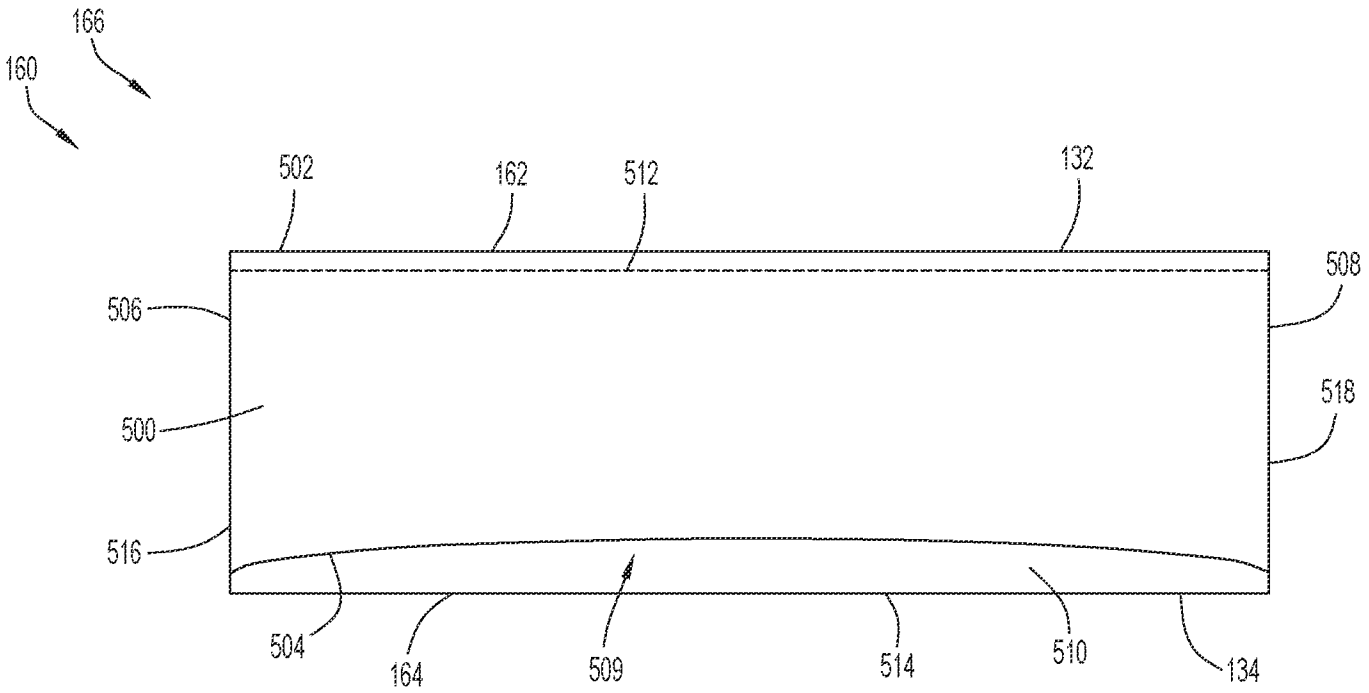
FIG. 5 illustrates a schematic view of the front side of the pocket of the embodiment of the garment illustrated in FIG. 1.

As best illustrated in FIG. 5, the second flap 510 includes a top edge 512 and a bottom edge 514. The top edge 512 of the second flap 510, shown in phantom in FIG. 5, may be disposed proximate to the top edge 132 of the waist portion 130 of the pants 10 and the top edge 502 of the first flap 500. As illustrated, the top edge 512 of the second flap 510 may be disposed underneath the first flap 500. Thus, the first flap 500 at least partially lies overtop the second flap 510 such that the top edge 512 of the second flap 510 is covered by the first flap 500. The second flap 510 further includes a bottom edge 514 opposite of the top edge 512, where the bottom edge 514 may be exposed and fixedly coupled to the bottom edge 134 of the waist portion 130, such that the bottom edge 514 appears to be aligned with the bottom edge 134 of the waist portion 130. In other words, the bottom edge 514 of the second flap 510 of the waist pocket 160 may form the portion of the bottom edge 134 of the waist portion 130 at the location where the waist pocket 160 is disposed on the waist portion 130. Thus, by the positioning of the waist pocket 160 illustrated in FIG. 1, the second flap 510 may also be fixedly coupled to the top edge 142 of the first leg portion 140 and the top edge 152 of the second leg portion 150. Similar to the first flap 500, the second flap 510 may also include sides 516, 518 that may be fixedly coupled to the waist portion 130. In addition, the sides 516, 518 of the second flap 510 may be fixedly coupled to the sides 506, 508 of the first flap 500. While the schematic drawing of FIG. 5 illustrates that the waist pocket 160 is substantially rectangular, in other embodiments of the waist pocket, the sides of the waist pocket formed by sides 506, 508 of the first flap 500 and sides 516, 518 of the second flap 510 may be angled to form a substantially trapezoidal waist pocket 160.

The first flap 500 and the second flap 510 may be constructed from a 100% polyester fabric, or, because the first flap 500 and the second flap 510 from a portion of the waist pocket 160, which is inline with the waist portion 130, the first flap 500 and the second flap may be constructed from a blended fabric of polyester and elastane (e.g., 86% polyester and 14% elastane). Thus, the flaps 500, 510 may be either non-resilient, where the flaps 500, 510 are not configured to stretch, or the flaps 500, 510 may be constructed to be resilient/elastomeric, where the flaps 500, 510 are configured to stretch and deform. In the embodiment of the pants 10 where the flaps 500, 510 are not resilient, at least the bottom edge 502 of the first flap may contain an elastomeric member with an undercut length, as explained previously, to return the bottom edge 504 of the first flap 500 to its position proximate to the bottom edge 164 of the waist pocket 160 after manipulation. In the embodiment of the pants 10, where the flaps 500, 510 are configured to be resilient, the flaps 500, 510 are configured to stretch and deform with the waist portion 130.

Figure 6A:
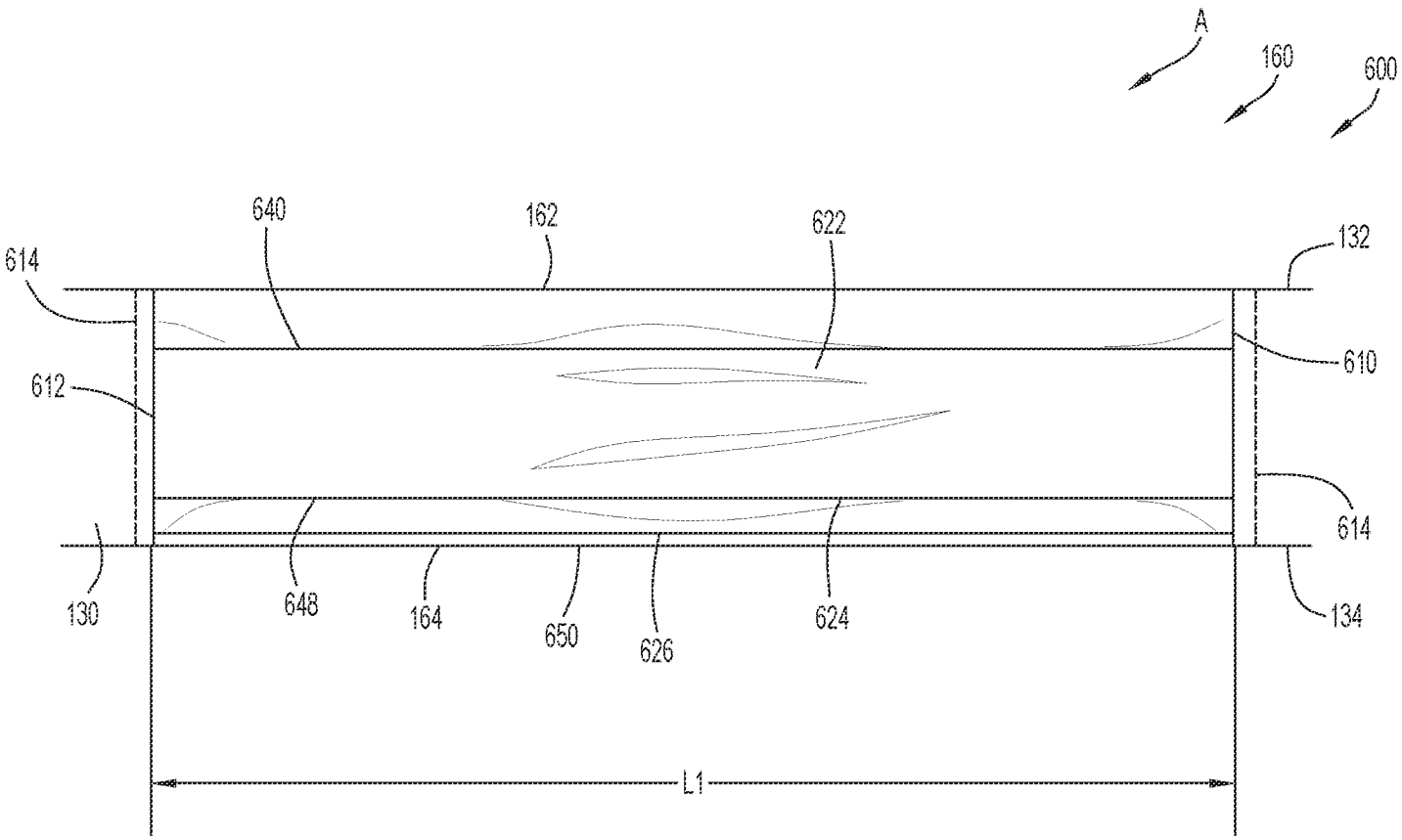
FIG. 6A illustrates a schematic view of the rear side of the pocket of the embodiment of the garment illustrated in FIG. 1, the pocket being in the empty configuration.
Figure 6B:
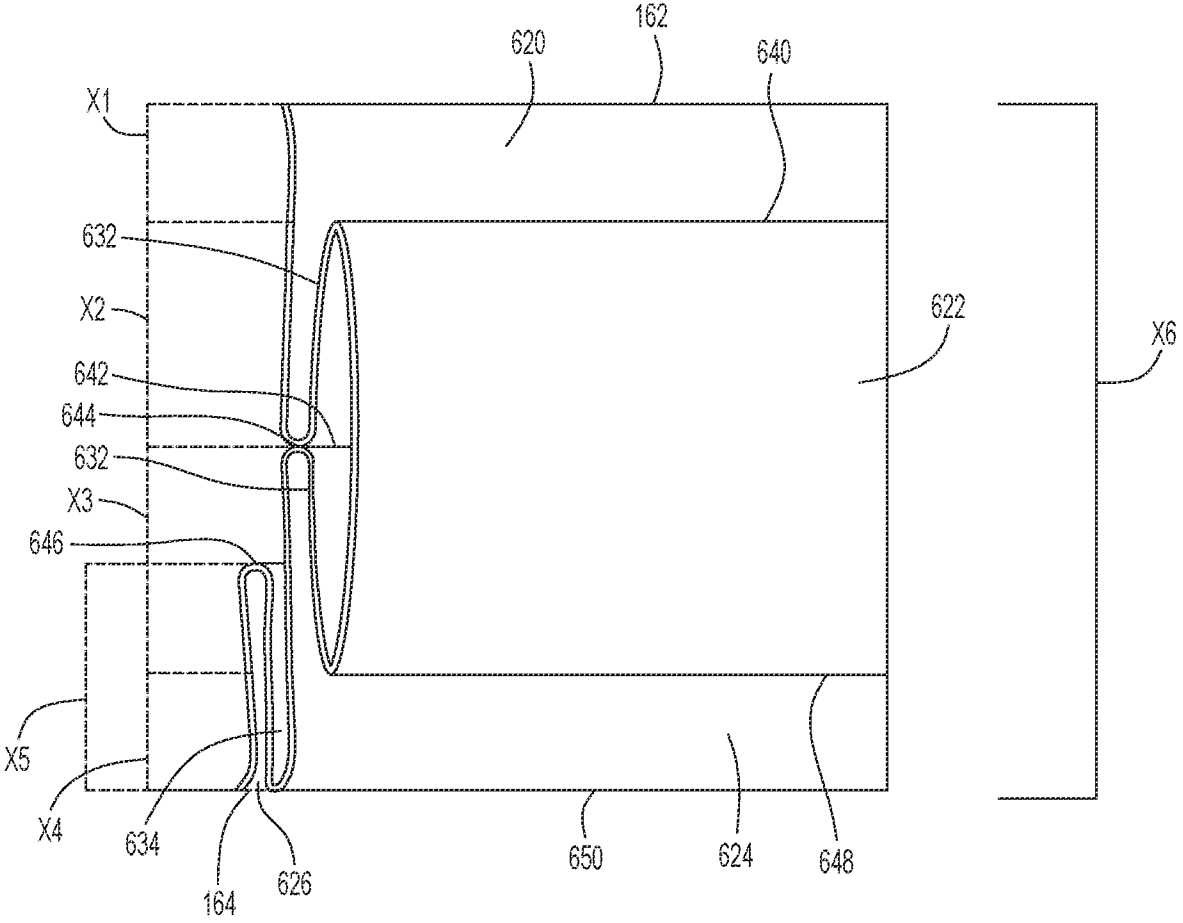
FIG. 6B illustrates a detailed view of the folds and panels of the pocket of the embodiment of the garment illustrated in FIG. 1 when the pocket is in the empty configuration.

FIGS. 6A and 6B illustrate that a rear view of the waist pocket 160 (e.g., viewing the side or surface of the waist pocket 160 that faces the interior of the pants 10) shows the various fold lines of the waist pocket 160. As illustrated, the rear side 600 of the waist pocket 160 includes a first side 610 and a second side 612 opposite the first side 610. The first and second sides 610, 612 are coupled to the waist portion 130 of the pants 10. Both the first side 610 and the second side 612 are coupled to the waist portion 130 of the pants 10 via stitching 614. The first and second sides 610, 612 may be coupled to the waist portion 130 via other means, such as, but not limited to, adhesives, tape, bonding, etc.

Figure 6C:
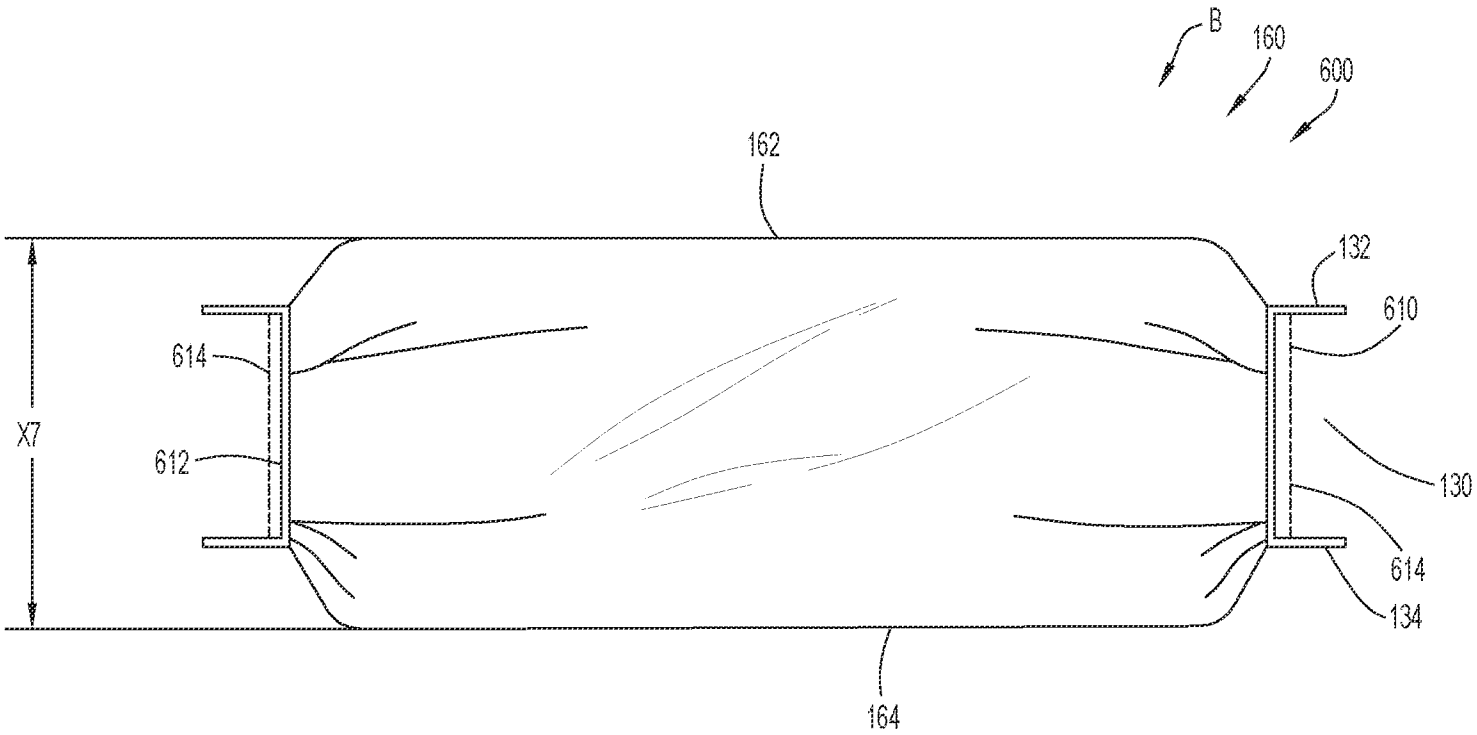
FIG. 6C illustrates a schematic view of the rear side of the pocket of the embodiment of the garment illustrated in FIG. 1, the pocket being in the expanded configuration.

The waist pocket 160 illustrated in FIGS. 6A and 6B is in a first or empty configuration A, while the waist portion 160 illustrated in FIG. 6C is in a second or expanded configuration B. As best illustrated in FIG. 6B, when in the empty configuration A, the rear side 600 of the waist pocket 160 contains four sections facing a first, or interior, direction (these sections face towards the interior of the pants 10): first section 620, second section 622, third section 624, and fourth section 626. The rear side 600 of the waist pocket 160 also contains three sections facing a second, or exterior direction (these sections face towards the exterior of the pants 10): fifth section 630, sixth section 632, and seventh section 634. Each of the sections 620, 622, 624, 626, 630, 632, 634 are separated by a plurality of fold lines 640, 642, 644, 646, 648, 650. As illustrated, the first section 620 is defined by the top edge 162 of the waist pocket 160 and the second fold line 642. The fifth section 630 is defined by the second fold line 642 and the first fold line 640. The second section 622 is defined by the first fold line 640 and the fifth fold line 648. The sixth section 632 is defined by the fifth fold line 648 and the third fold line 644. The third section 624 is defined by the third fold line 644 and the sixth fold line 650. The seventh section 634 is defined by the sixth fold line 650 and the fourth fold line 646. Finally, the fourth section 626 is defined by the fourth fold line 646 and the bottom edge 164 of the waist portion 160.

As further illustrated in FIG. 6B, when the waist portion 160 is in the empty configuration A, the fifth, sixth, and seventh sections 630, 632, 634 are not exposed. Furthermore, the second section 622 is fully exposed, while the first and third sections 620, 624 are at least partially exposed. The fourth section 626 may be at least partially exposed (as shown by the small exposed portion illustrated in FIG. 6A proximate to the bottom edge 164 of the waist pocket 160), or may not be exposed. As further illustrated, the fifth section 630 faces the first section 620, the sixth section 632 faces the third section 624, and the seventh section 634 faces the fourth section 624. The fifth section 630 and at least a portion of the second section 622 cover at least a portion of the first section 620, and leaves a portion of the first section 620 exposed. Similarly, the sixth section 632 and at least a portion of the second section 622 cover at least a portion of the third section 624, and leaves a portion of the third section 624 exposed.

Furthermore, as best illustrated in FIG. 6A, the total length of the waist pocket 160, or the distance between the first side 610 and the second side 612, is represented by L1. The sections 620, 622, 624, 626, 630, 632, 634 and the fold lines 640, 642, 644, 646, 648, 650 span the distance L1 across the waist pocket 160. The sections 620, 622, 624, 626, 630, 632, 634 and the fold lines 640, 642, 644, 646, 648, 650, moreover, are also bound or coupled to the waist portion 130 via stitching 614. Because the sections 620, 622, 624, 626, 630, 632, 634 and the fold lines 640, 642, 644, 646, 648, 650 are bound by stitching 614, when the waist pocket 160 returns to the empty configuration A from the expanded configuration B, the sections 620, 622, 624, 626, 630, 632, 634 and the fold lines 640, 642, 644, 646, 648, 650 are reformed and take shape.

As best illustrated in FIG. 6B, the first section 620 has a height of the combination of X1 and X2, where X2 is the height of the fifth section 630 and X1 is the height of the exposed portion of the first section 620. In some embodiments, X1 and X2 may be equal to one another, while in other embodiments X2 may be larger than X1, or X1 may be larger than X2. Furthermore, the sixth section 632 may have a height of X3, where X3 may be equal to X2, or may be smaller or larger than X2. The second section 622 may have a height of the combination of heights X2 and X3. Additionally, the third section has a height of the combination of heights X3 and X4, where X4 is the height of the exposed portion of the third section 624. The fourth section 624 and the seventh section 634 have a height of X5. As further illustrated, the total height of the waist pocket 160 is X6, which is the combination of heights X1, X2, X3, and X4. Because, as previously explained and as illustrated in FIG. 6A, the top edge 162 of the waist pocket 160 is aligned with the top edge 132 of the waist portion 130, and the bottom edge 164 of the waist pocket 160 is aligned with the bottom edge 134 of the waist portion 130, the height of the waist portion 130 may also be equal to the height of waist pocket 160, which is represented by X6.

In one embodiment, X1 may be equal to 0.25 inches, and X2 may be equal to 0.5 inches. Similarly, X3 may be equal to 0.5 inches and X4 may be equal to 0.25 inches. Thus, because the second section 622 has a height equal to the combination of heights X2 and X3, the height of the second section 622 may be approximately 1 inch. As further illustrated, X5 may be equal to 0.5 inches, and the total height X6 of the waist pocket 160 may be approximately 4.5 inches. The length L1 between the first side 610 and the second side 612 may be equal to 7.25 inches.

As previously explained, the waist pocket 160 in the expanded configuration B is illustrated in FIG. 6C. The waist pocket 160 is reconfigured from the empty configuration A to the expanded configuration B when an item or items (e.g., mobile phone, wallet, credit card, keys, etc.) are placed within the waist pocket 160. As illustrated, when items are placed within the waist pocket 160, the pocket 160 is expanded in the vertical direction such that the distance between the top edge 162 and the bottom edge 164 increases from the height of X6 illustrated in FIG. 6B to the height of X7 illustrated in FIG. 6C while the height of the waist portion 130 remains the same at a height of X6. Thus, the height X7 is greater than the height X6. With the height X7 being larger in the expanded configuration B than the height X6 in the empty configuration A, the top edge 162 of the waist pocket 160 no longer aligns with the top edge 132 of the waist portion 130. Furthermore, the bottom edge 164 of the waist pocket 160 no longer aligns with the bottom edge 134 of the waist portion 130 when the pocket 160 is in the expanded configuration B. As illustrated, the top edge 162 of the waist pocket 160 is disposed above the top edge 132 of the waist portion 130, while the bottom edge 164 of the waist pocket 160 is disposed lower than the bottom edge 134 of the waist portion 130. Additionally, when the waist pocket 160 is in the expanded configuration B, the rear side 600 may no longer contain the plurality of sections 620, 622, 624, 626, 630, 632, 634 and the plurality of fold lines 640, 642, 644, 646, 648, 650. The size of the object placed within the pocket 160 dictates the height X7 of the pocket 160 in the expanded configuration, and also dictates how many of the plurality of sections 620, 622, 624, 626, 630, 632, 634 and plurality of fold lines 640, 642, 644, 646, 648, 650 that are no longer present.

In one embodiment, the rear side 600 of the waist pocket 160 may be constructed from a polyester blended fabric. Thus, the rear side 600, with the plurality of sections 620, 622, 624, 626, 630, 632, 634 and the plurality of fold lines 640, 642, 644, 646, 648, 650, may be constructed from a fabric that is 90% polyester and 10% elastane. This embodiment of the rear side 600 of the waist pocket 160 may have a slightly less resilient structure than that of the waist portion 130 and front flaps 500, 510 of the pocket 160. This construction, however, provides the rear side 600 with a degree of resiliency that enables the rear side 600 to stretch into the expanded configuration B when an object is placed within the interior of the waist pocket 160, and return to the empty configuration A, where the rear side 600 reforms the plurality of sections 620, 622, 624, 626, 630, 632, 634 and the plurality of fold lines 640, 642, 644, 646, 648, 650. In addition, because the rear side 600 of the waist pocket 160 is facing the interior of the pants 10, when the pants 10 are worn by a user, the rear side 600 may abut or contact the user. Thus, the rear side 600 may include anti-microbial/moisture wicking properties to prevent sweat from the user's body coming in contact with the objects placed within the waist pocket 160.

In order to place an object within the waist pocket 160 of the embodiment of the pants 10 illustrated in FIGS. 1-5, 6A, 6B, and 6C, the user must separate the first flap 500 from the second flap 520 to gain access to the interior of the waist pocket 160. In the closed position, illustrated in FIGS. 1 and 5, the first flap 500 lies at least partially over the second flap 510, such that the interior surface of the first flap 500 abuts against, contacts, or is adjacent to the exterior surface of the second flap 510. Additionally, when in the closed position, the bottom edge 504 of the first flap 500 is oriented lower than the top edge 512 of the second flap 510, such that the first flap 500 covers the top edge 512 of the second flap 500. In other words, in the closed position, the top edge 512 of the second flap 500 is oriented closer to the top edge 162 of the waist pocket 160 than the bottom edge 504 of the first flap 500, which overlies the second flap 510. When a user manipulates the waist pocket 160 to place objects within the waist pocket 160, the first flap 500 is at least partially pulled away from the second flap 510, such that at least a portion of the interior surface of the first flap 500 is disposed or spaced away from the exterior surface of the second flap 510. Thus, when opening the waist pocket 160, at least a portion of the interior surface of the first flap 500 is oriented farther away from the exterior surface of the second flap 510 than when in the waist pocket 160 is in the closed position.

Once the first flap 500 is oriented away from the second flap 510, an opening may be created by the first flap 500 and the second flap 510. This opening provides access to the top edge 512 of the second flap 500, which can be pulled downward to access the interior of the waist pocket 160. The bottom edge 504 of the first flap 500 may be pulled closer to the top edge 162 of the waist pocket 160, while the top edge 512 of the second flap 510 may be pulled downward, away from the top edge 162 of the waist pocket 160. Thus, the top edge 512 of the second flap 500 may be at least partially exposed, such that the first flap 500 does not cover or overlie the entire top edge 512 of the second flap 510. By pulling the top edge 512 of the second flap 500 downward and the bottom edge 504 of the first flap 500 upward, access is provided to the interior of the waist pocket 160.

An object or item (i.e., mobile phone) may then be slipped or forced between the interior surface of the first flap 500 and the exterior surface of the second flap 510 such that the object moves past the bottom edge 504 of the first flap 500 and the top edge 512 of the second flap 500, and into the interior of the waist pocket 160. When an object is positioned within the interior of the waist pocket 160, the waist pocket 160 is reconfigured from the empty configuration A, illustrated in FIGS. 6A and 6B, to the expanded configuration B, illustrated in FIG. 6C. The waist pocket 160 expands to the expanded configuration B to accommodate object(s) that may be larger in width and/or depth than the waist pocket 160 in the empty configuration A. After the object has been secured within the waist pocket 160, the first flap 500 and the second flap 510 return to their closed position, where the first flap 500 lies at least partially over the second flap 510, such that the interior surface of the first flap 500 abuts against the exterior surface of the second flap 510. Furthermore, the bottom edge 504 of the first flap 500 is oriented lower than the top edge 512 of the second flap 510, such that the first flap 500 covers the top edge 512 of the second flap 500.

As best illustrated in FIG. 5, the waist pocket 160 is substantially equivalent to the size and shape of the second flap 510. The waist pocket 160 is defined by and disposed between the first and second flaps 500, 510, the rear side 600 of the waist pocket 160, and the sides 610, 612 of the waist portion 160. The sides 610, 612 of the waist pocket 160 are substantially vertical, making the waist pocket 160 substantially rectangular. In other embodiments of the waist pocket 160, however, these sides 610, 612 may be angled or curved to give the waist pocket 160 another shape.

Figure 7:
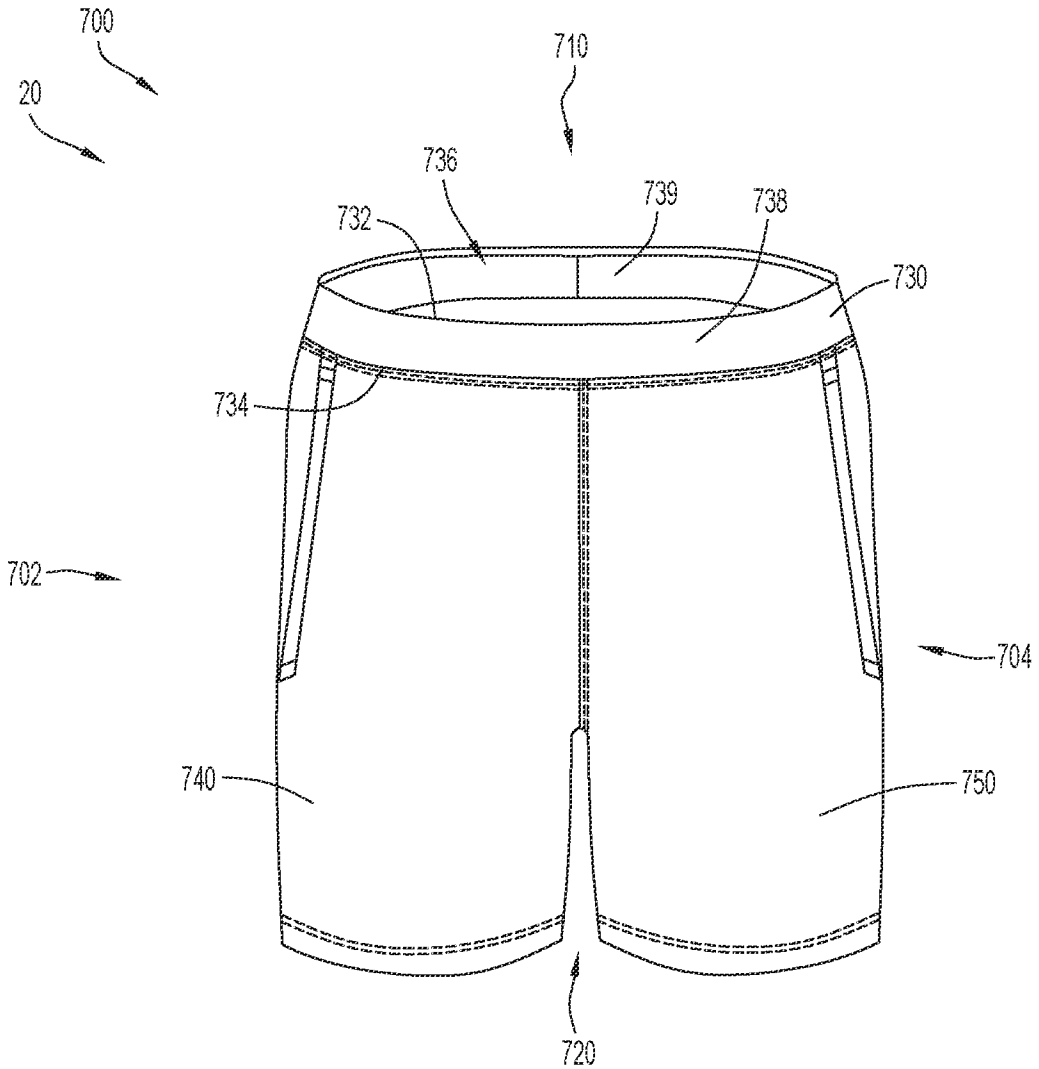
FIG. 7 illustrates a front view of a garment in accordance with a second embodiment of the present invention.

FIGS. 7, 8A, 8B, 9A, 9B, 10, 11A, 11B, 12A, and 12B illustrate a second embodiment of a garment or pants that can be worn by a person, where the garment includes a pocket in the waistband of the garment. Similar to the first embodiment of the pants 10, the second embodiment of the pants 20 include a front side 700, and a rear side oriented opposite of the front side 700, a first (e.g., right) side 702 connecting the front side 700 to the rear side, and a second (e.g., left) side 704 that is oriented opposite of the first side 702 and also connects the front side 700 to the rear side. The second embodiment of the pants 20 further include a top side 710 and a bottom side 720 oriented opposite of the top side 710. Also similar to the first embodiment of the pants 10, the second embodiment of the pants 20 may contain a waist portion 730, a first leg portion 740 extending downwardly from the waist portion 730 proximate the first side 702, and a second leg portion 750 extending downwardly from the waist portion 730 proximate the second side 702. As illustrated in FIG. 7, the waist portion or waistband 730 is disposed proximate to the top 710 of the pants 20 and includes a top edge 732 and a bottom edge 734. The waist portion 730 defines opening 736 proximate to the top side 710 of the pants 20. Opening 736, similar to opening 136 of the first embodiment of the pants 10, is configured to receive portions of the body of the user wearing the pants 20. The waist portion 730 further includes an exterior surface 738 and an interior surface 739, where the interior surface 739 of the waist portion 730 contacts the portion of the body that the waist portion encircles. As best illustrated in FIG. 7, the second embodiment of the pants 20 differs from the first embodiment of the pants 10 in that the pocket 160 of the first embodiment of the pants 10 is disposed at least partially on the exterior surface 138 of the waist portion 130 such that the waist pocket 160 is visible, while the waist pocket of the second embodiment of the pants 20 is not visible when viewing the exterior surface 738 of the waist portion 730.

Figure 8A:
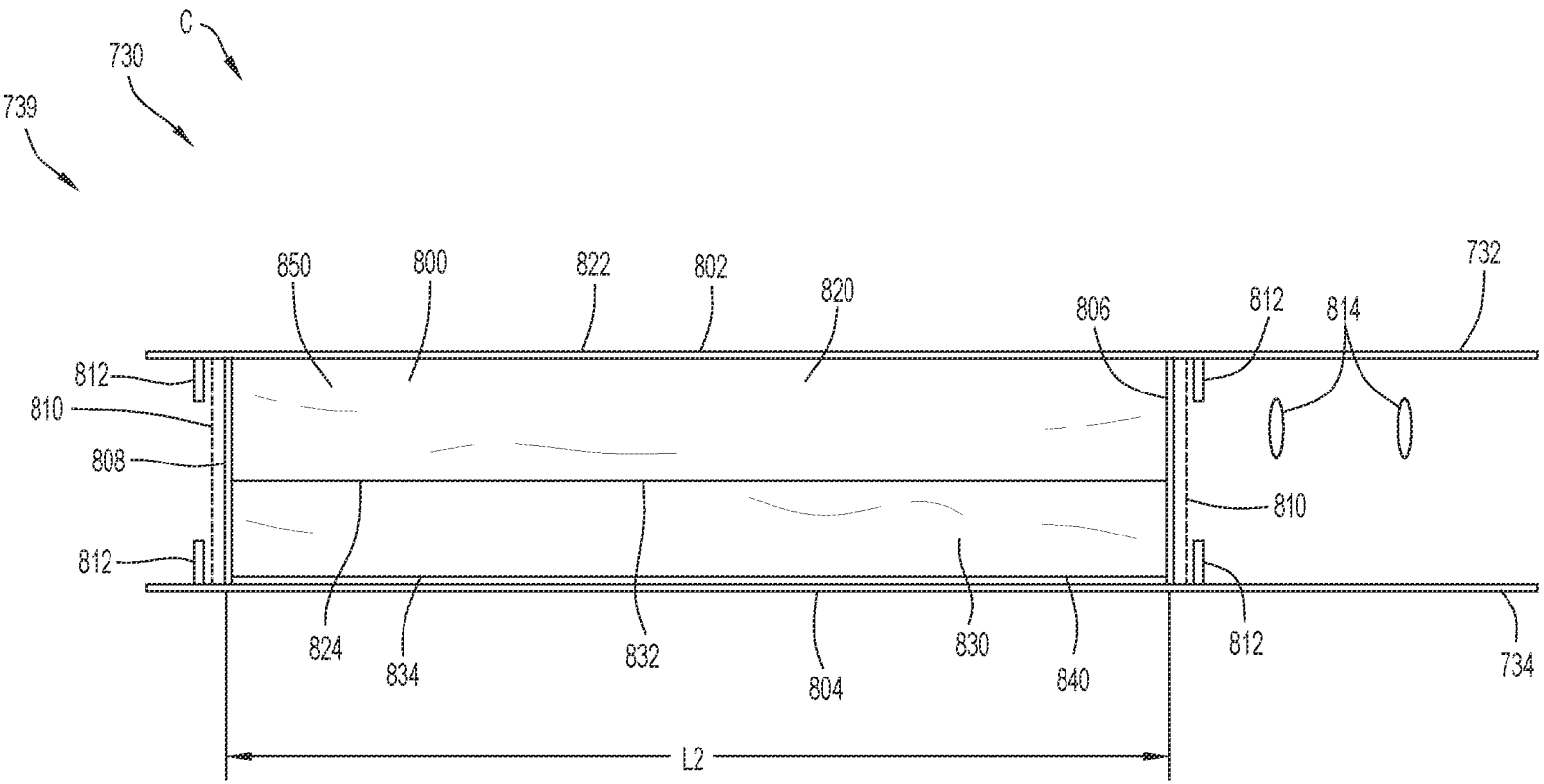
FIG. 8A illustrates a schematic view of the inner side of the pocket of the embodiment of the garment illustrated in FIG. 7, the pocket being in the empty configuration.
Figure 8B:
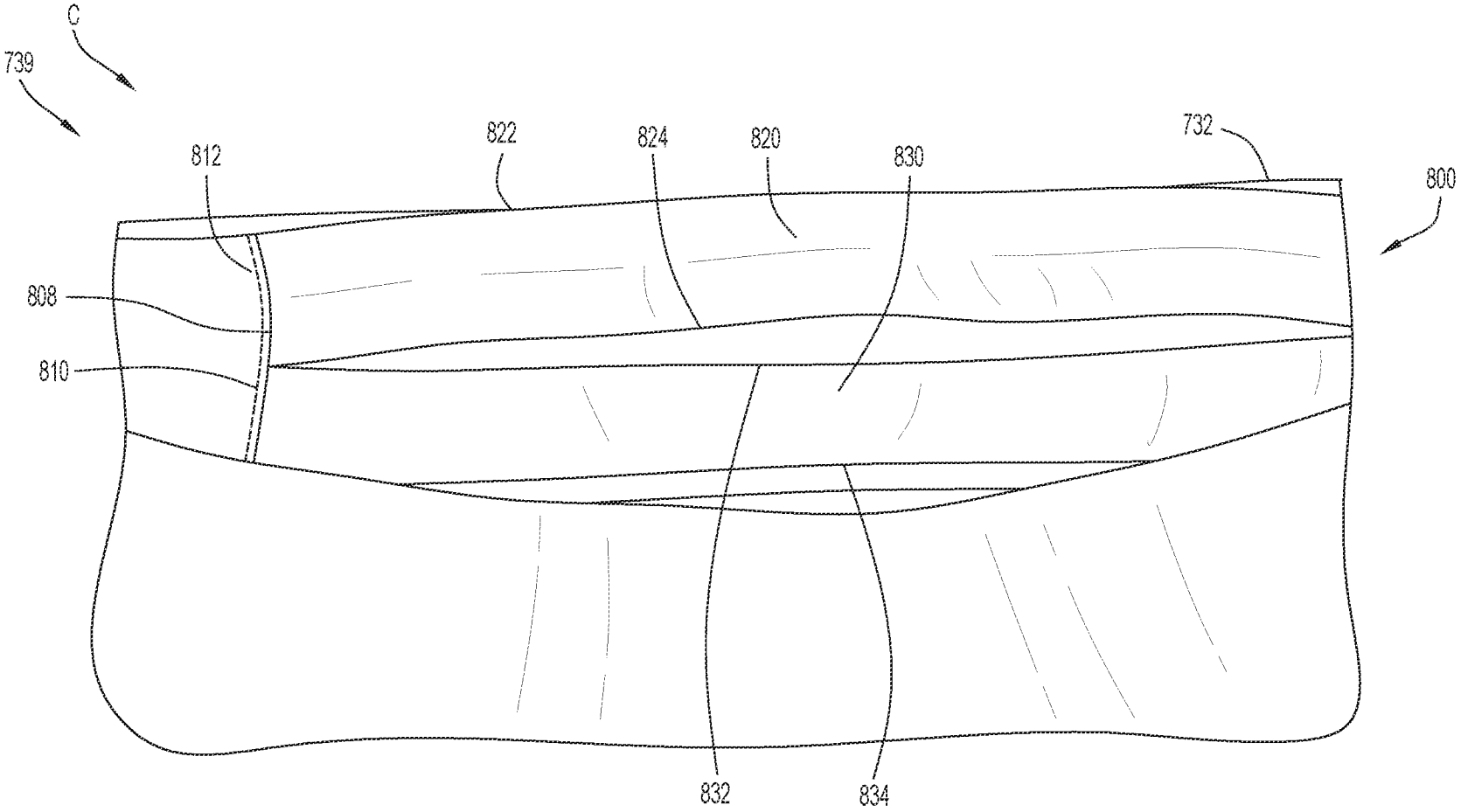
FIG. 8B illustrates an interior view of the embodiment of the garment illustrated in FIG. 7, and illustrates the pocket in the empty configuration.

Instead, as best illustrated in FIGS. 8A and 8B, the waist pocket 800 of the second embodiment of the pants 20 is disposed on the interior surface 739 of the waist portion 730. The waist pocket 800 may be disposed centrally on the interior surface 739 of the front side 700 of the waist portion 730 of the pants 20. The waist pocket 800 illustrated in FIGS. 8A and 8B is in the first or empty configuration C. The waist pocket 800 includes a top edge 802, a bottom edge 804 opposite the top edge 802, a first side 806 proximate the first side 702 of the pants 20, and a second side 808 proximate the second side 704 of the pants 20. The total length of the waist pocket 800, or the distance between the first side 806 and the second side 808, is represented by L2. As illustrated in FIGS. 8A and 8B, the top edge 802 of the waist pocket 800 is disposed proximately to, and aligned with, the top edge 732 of the waist portion 730. Similarly, the bottom edge 804 of the waist pocket 800 is disposed proximate to, and aligned with, the bottom edge 734 of the waist portion 730. The first side 806 and the second side 808 are coupled to the waist portion 130 of the pants 10 via stitching 810 and/or bar tacks 812. The stitching 810 and the bar tacks 812 may not be visible from the exterior surface 738 of the waist portion 730. In other embodiments, the first and second sides 806, 808 may be coupled to the waist portion 730 via other means, such as, but not limited to, adhesives, tape, bonding, etc.

As further illustrated in FIG. 8A, proximate to the first side 806 of the pocket 800, the interior surface 739 of the waist portion 730 includes a set of bar tacks 814 that define openings through which a drawstring may be threaded. Typical athletic shorts contain a drawstring that extends centrally from the interior surface of the waist portion, where the drawstrings are operable to tighten the waist portion. However, when the pocket 800 is centrally disposed on the interior surface 739 of the waist portion 730 of the pants 20, the drawstrings extending from the interior surface 739 of the waist portion 730 may be shifted towards the first side 702 or the second side 704. Thus, as FIG. 8A illustrates, the set of bar tacks 814 proximate to the first side 806 of the pocket 800 define openings that enable a drawstring to be threaded through the openings, where a drawstring extending from the bar tacks 814 may be used to tighten the waist portion 730 of the pants 20.

The embodiment of the pocket 800 illustrated in FIGS. 8A and 8B includes a backing sheet 850 that contains three exposed panels 820, 830, and 840 when in the empty configuration C. First exposed panel 820 includes a top edge 822 and a bottom edge 824. Second exposed panel 830 also includes a top edge 832 and a bottom edge 834. As illustrated, the bottom edge 824 of the first exposed panel 820 may be disposed proximate to, and aligned with, the top edge 832 of the second exposed panel 830. However, FIG. 8B illustrates the bottom edge 824 of the first exposed panel 820 slightly separated from the top edge 832 of the second exposed panel 830, revealing other panels of the pocket 800. As further illustrated, the top edge 822 of the first exposed panel 820 may be aligned with the top edge 802 of the pocket 800, and thus the top edge 732 of the waist portion 730, because the top edge 822 of the first exposed panel 820 may also form, as further explained below, the top edge 802 of the pocket 800 when the pocket is in the empty configuration C. In addition, as best illustrated in the schematic illustration of FIG. 8A, the bottom edge 834 of the second exposed portion 830 may be disposed proximate to the bottom edge 804 of the pocket 800, but is disposed far enough away from the bottom edge 804 of the pocket 800 to at least partially expose third exposed panel 840.

Figure 9A:
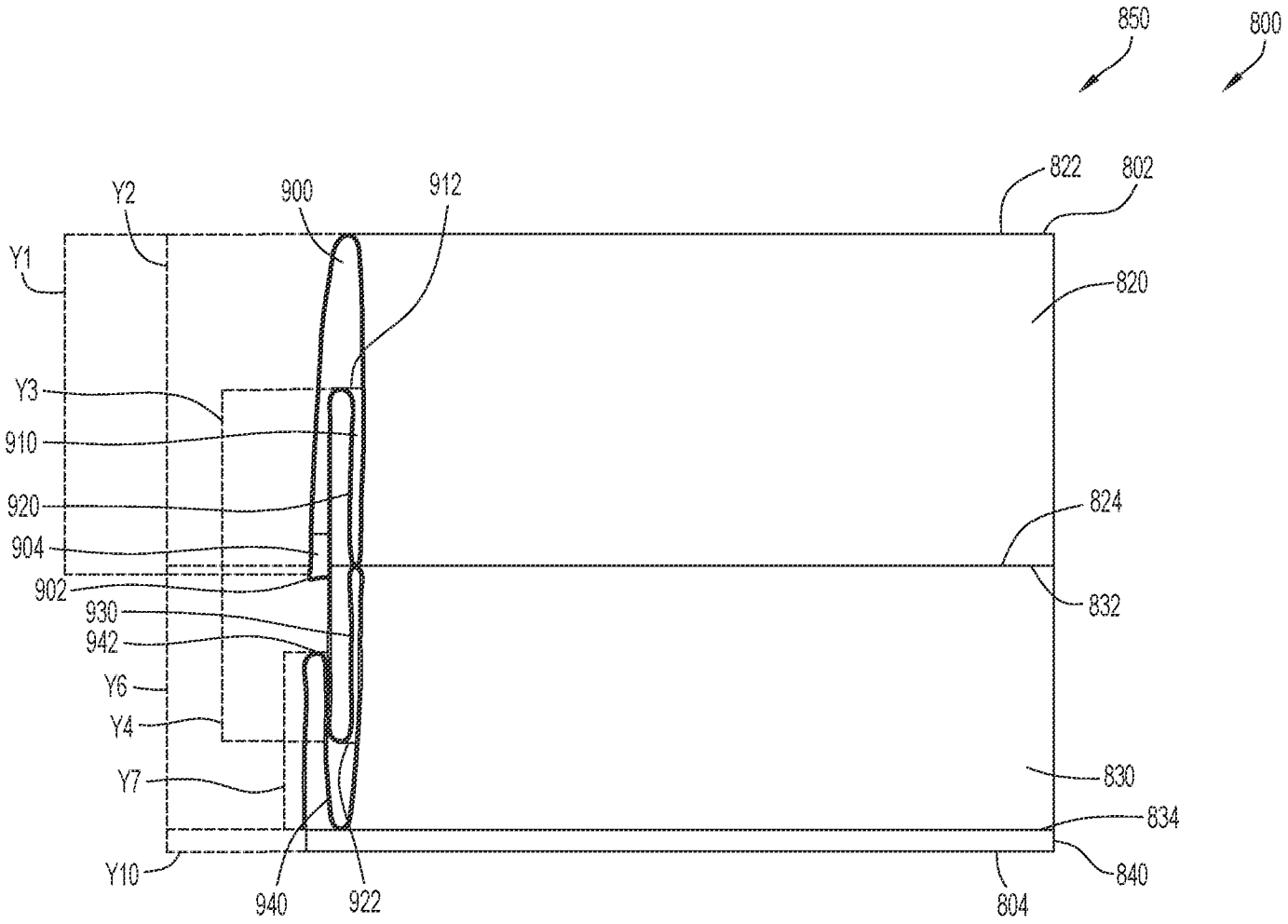
FIG. 9A illustrates a detailed view of the folds and panels of the pocket of the embodiment of the garment illustrated in FIG. 7 when the pocket is in the empty configuration.

As illustrated in FIG. 9A, the backing sheet 850 of the pocket 800 includes a plurality of exposed or partially exposed panels 820, 830, 840, and a plurality of unexposed panels 900, 910, 920, 930, 940. The exposed panels 820, 830, 840 are exposed when viewing the interior surface 739 of the waist portion 730. As previously explained, the first exposed surface 820 includes a top edge, or top fold line, 822, and a bottom edge, or bottom fold line, 824. Thus, first exposed surface 820 is defined by the top edge 822 and the bottom edge 824. The first unexposed panel or end panel 900 is defined by bottom edge 902 and top edge 822, and is covered by, or layered behind, the first exposed panel 820. Thus, when the pocket 800 is in the empty configuration C, the first unexposed panel 900 is disposed within the interior of the pocket 800. The bottom edge 902 of the first unexposed panel 900 may include a binding 904 that may encase elastic is undercut so that, when manipulated, the binding 904 and bottom edge 902 of the unexposed panel 900 may return to its position within the interior of the waist pocket 800. The top edge 822 may form the top edge 802 of the pocket 800, where the first exposed panel 820 on one side of the top edge 822 is disposed on the exterior surface of the pocket 800 and the first unexposed panel 900 on the opposite side of the top edge 822 is disposed within the interior of the pocket 800 between the waist portion 730 and the first exposed panel 820.

As further illustrated in FIG. 9A, the second unexposed panel 910 may be defined by a first interior fold line 912 and bottom edge 824 of the first exposed panel 820. Thus, as illustrated, the second unexposed panel 910 is covered by, or layered behind, the first exposed panel 820. The third unexposed panel 920 may be defined by the first interior fold line 912 and the second interior fold line 922. In addition, the fourth unexposed panel 930 may be defined by the second interior fold line 922 and the top edge 832 of the second expose panel 830, while, as previously explained, the second exposed panel 830 may be defined by the top edge 832 and the bottom edge 834. Thus, as illustrated, the fourth unexposed panel 930 is covered by, or layered behind, the second exposed panel 830. The third unexposed panel 920 may be located, or layered, behind both the second and fourth unexposed panels 910, 930 and the first and second exposed panels 820, 830. If the bottom edge 824 of the first exposed panel 820 separates from the top edge 832 of the second exposed panel 830, the third unexposed panel 920 may be at least partially exposed, as illustrated in FIG. 8B.

The fifth unexposed panel 940 may be defined by the bottom edge 834 of the second exposed panel 830 and the third interior fold line 942. As illustrated, the fifth unexposed panel 940 may be layered behind, and covered by, the second exposed panel 830, and may be at least partially layered behind the fourth unexposed panel 930. Finally, the third exposed panel 830 may be defined by the third interior fold line 942 and the bottom edge 804. As illustrated in FIGS. 8A and 9A, the third exposed panel 830 may be partially exposed with a portion of the third exposed panel 830 being layered behind the second exposed panel 830.

Figure 9B:
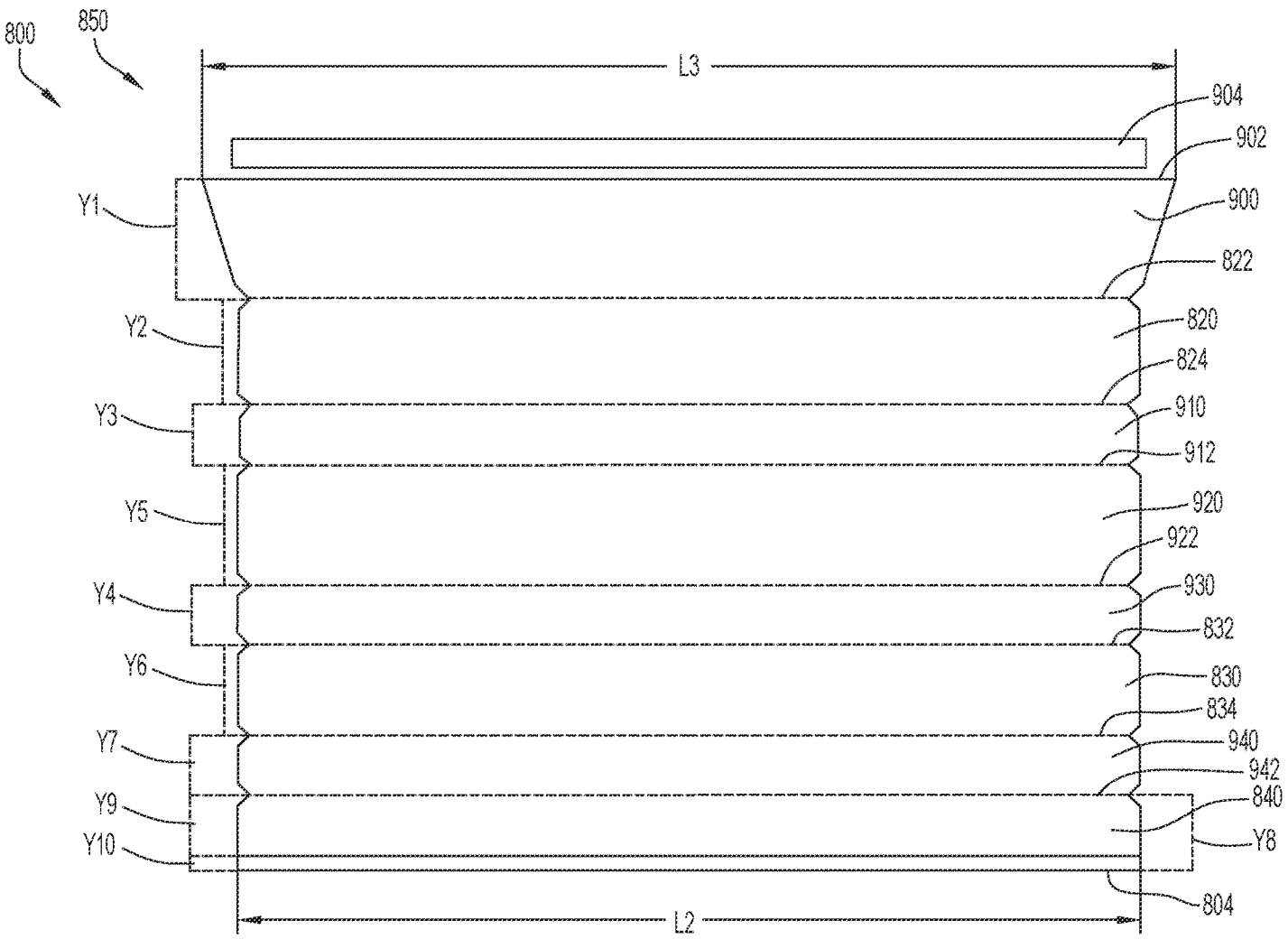
FIG. 9B illustrates a detailed view of the interior of the pocket of the embodiment of the garment illustrated in FIG. 7, where the pocket is completely unfolded and laid flat.

The backing sheet 850 of the pocket 800 being completely unfolded is illustrated in FIG. 9B. Thus, FIG. 9B illustrates each of the panels 820, 830, 840, 900, 910, 920, 930, 940 and each of the fold lines 822, 824, 832, 834, 912, 922, 942. As illustrated, the shaded panels 820, 830 are the panels that are exposed to the interior of the pants 20 when the pocket 800 is in the empty configuration C. The unshaded panels 900, 910, 920, 930, 940 are the panels that are not exposed when the pocket 800 is in the empty configuration C. As further illustrated in FIG. 9B, panel 840 is partially shaded, which indicates the portion of the panel 840 that is exposed and the portion of the panel 840 that is not exposed when the pocket 800 is in the empty configuration C.

As best illustrated in FIGS. 9A and 9B, the first unexposed panel 900 may have a height Y1 that spans between the bottom edge 902 and top edge/fold line 822. In addition, FIG. 9B illustrates that the portion of the first unexposed panel 900 proximate to the top edge/fold line 822 has a length of L2, while the portion of the first unexposed panel 900 proximate to the bottom edge 902 has a length of L3. The length L3 may be greater than the length L2, where the length L2 is also the distance between the first and second sides 806, 808 of the pocket 800. As further illustrated in FIGS. 9A and 9B, the first exposed panel 820 may have a height Y2 that spans between the top edge/fold line 822 and the bottom edge/fold line 824. The second unexposed panel 910 may have a height of Y3 that spans between the bottom edge/fold line 824 and the fold line 912, while the fourth unexposed panel 930 may have a height of Y4 that spans between the fold line 922 and the top edge/fold line 832. As best illustrated in FIG. 9B, the third unexposed panel 920 may have a height of Y5, which may be equivalent to the combination of Y3 and Y4. In other words, and as illustrated in FIG. 9A, the height Y5 of the third unexposed panel 920 may be equivalent to the combined heights of the second unexposed panel 910 and the fourth unexposed panel 930.

As further illustrated, the second exposed panel 830 may have a height of Y6 that spans between the top edge/fold line 832 and the bottom edge/fold line 834. The fifth unexposed panel 940 may have a height of Y7 that spans between the bottom edge/fold line 834 and the fold line 942. The third exposed panel 840, which is only partially exposed, may have a height of Y8 that spans between the fold line 942 and the bottom edge 804 of the pocket 800. As further illustrated, the unexposed portion of the third exposed panel 840 may have a height of Y9, which may be equivalent to the height Y7 of the fifth unexposed panel 940, and the exposed portion of the third exposed panel 840 may have a height of Y10.

In one embodiment of the pocket 800, Y1 may be equal to 1 inch, and Y2 may be equal to 0.875 inches. Heights Y3, Y4, Y7, and Y9 may all be equal to one another and equal to 0.5 inches. The height Y5 may be equal to 1 inch, while the height Y6 may be equal to 0.75 inches. In addition, height Y10 may be equal to 0.125 inches. Thus, the height Y8, which may be equal to Y9 plus Y10, may be 0.625 inches. The length L2 between the first side 810 and the second side 820 may be equal to 7.5 inches, while the length L3 of the bottom edge 902 of the first unexposed panel 900 may be 8 inches. Other embodiments of the pocket 800 may contain different dimensions.

Furthermore, as best illustrated in FIG. 8A, each of the panels 820, 830, 840, 900, 910, 920, 930, 940 and each of the fold lines 822, 824, 832, 834, 912, 922, 942 span the distance L2 across the waist pocket 800. The panels 820, 830, 840, 900, 910, 920, 930, 940 and the fold lines 822, 824, 832, 834, 912, 922, 942, moreover, are also bound or coupled to the waist portion 730 via stitching 810 and/or bar tacks 812. Because the panels 820, 830, 840, 900, 910, 920, 930, 940 and the fold lines 822, 824, 832, 834, 912, 922, 942 are bound by stitching 810 and/or bar tacks 812, when the waist pocket 800 returns to the empty configuration C from the expanded configuration D, the panels 820, 830, 840, 900, 910, 920, 930, 940 and the fold lines 822, 824, 832, 834, 912, 922, 942 are reformed and take shape.

In one embodiment, the waist pocket 800, and more specifically, the panels 820, 830, 840, 900, 910, 920, 930, 940, may be constructed from a polyester blended fabric similar to the front flaps 500, 510 or the rear side 600 of the first embodiment of the waist pocket 160. This construction, however, provides the pocket 800 with a degree of resiliency that enables the panels 820, 830, 840, 900, 910, 920, 930, 940 to stretch into the expanded configuration D, illustrated in FIGS. 12A and 12B, when an object is placed within the interior of the waist pocket 800, and return to the empty configuration C, where the plurality of panels 820, 830, 840, 900, 910, 920, 930, 940 and the plurality of fold lines 822, 824, 832, 834, 912, 922, 942 are reformed. In addition, because the panels 822, 824, 832, 834, 912, 922, 942 of the waist pocket 800 are facing the interior of the pants 20, when the pants 20 are worn by a user, the panels 822, 824, 832, 834, 912, 922, 942 may abut or contact the user. Thus, the panels 822, 824, 832, 834, 912, 922, 942 may include anti-microbial/moisture wicking properties to prevent sweat from the user's body coming in contact with the objects placed within the waist pocket 800.

Figure 10:
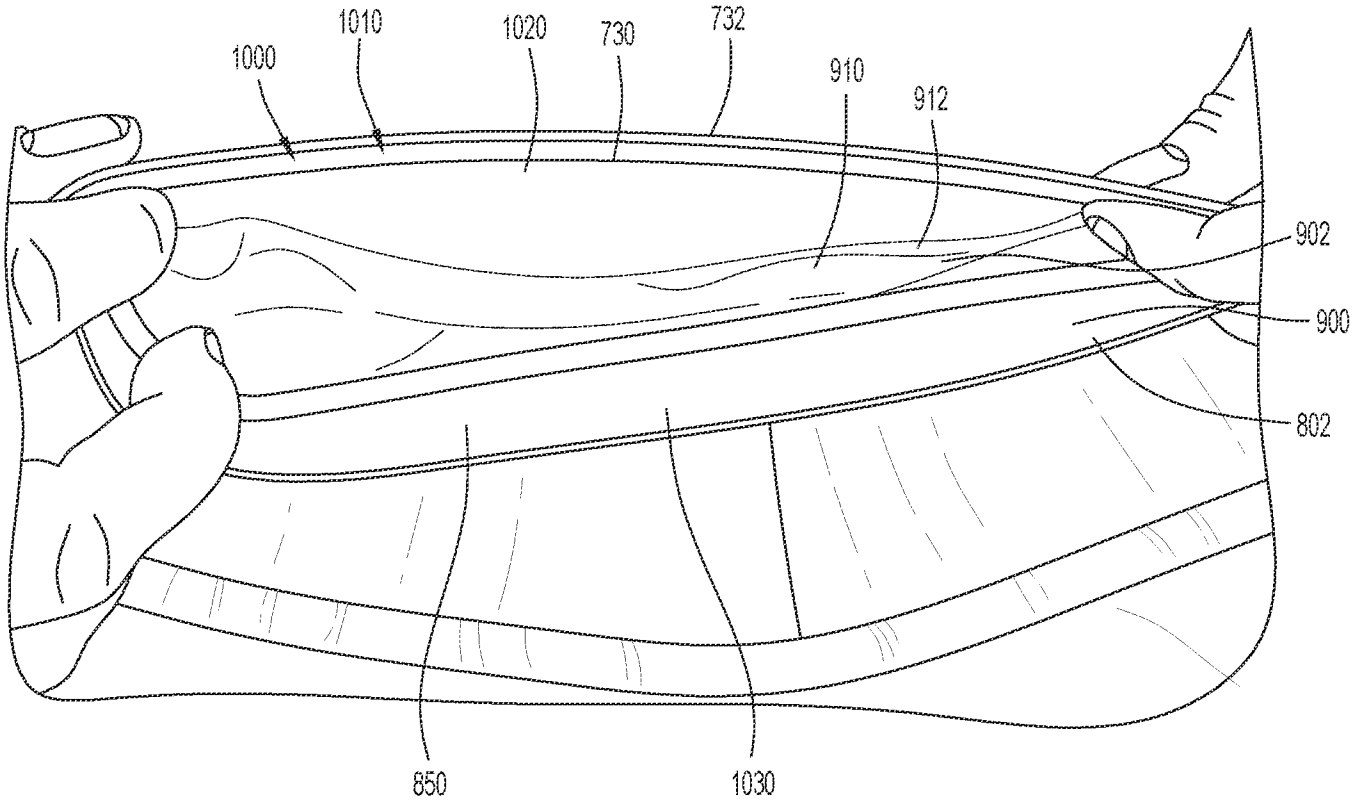
FIG. 10 illustrates a top view of the pocket of the embodiment of the garment illustrated in FIG. 7 in the open position.

In order to place objects (e.g., mobile electronic devices, wallets, credit cards, keys, etc.) within the pocket 800, the top edge 802 of the pocket 800 must first be separated from the top edge 732 of the waist portion 730 as illustrated in FIG. 10. Because the pocket 800 is disposed on the interior surface 739 of the waist portion 730, when separating the top edge 802 of the pocket 800 from the top edge 732 of the waist portion 730, the top edge 802 of the pocket 800 may be pulled towards the user wearing the pants 20 and/or the top edge 732 of the waist portion 730 may be pulled away from the user wearing the pants 20. As illustrated in FIG. 10, separating the top edge 802 of the pocket 800 from the top edge 732 of the waist portion 730 creates an opening 1000 that exposes the interior 1010 of the pocket 800. The interior 1010 of the pocket 800 may be defined by the panels 820, 830, 840, 900, 910, 920, 930, 940 and the interior surface 739 of the waist portion 730, where the interior surface 739 of the waist portion 730 is disposed opposite of the panels 820, 830, 840, 900, 910, 920, 930, 940. Thus, the interior surface 739 of the waist portion 730 may form the front side 1020 of the interior 1010 of the pocket 800, while the backing sheet 850 with panels 820, 830, 840, 900, 910, 920, 930, 940 may form at least a portion of the rear side 1030 of the interior 1010 of the pocket 800. The interior 1010 of the pocket 800 is also bound by the first and second sides 806, 808 of the pocket 800.

When viewing the interior 1010 of the pocket 800 through the opening 1000, at least some of the unexposed panels 900, 910, 920, 930, 940 and the fold lines 912, 922, 942 of the backing sheet 850 may be visible. Furthermore, the bottom edge 902 and the binding 904 of the first unexposed panel 900 may also be visible through the opening 1000.

Figure 11A:
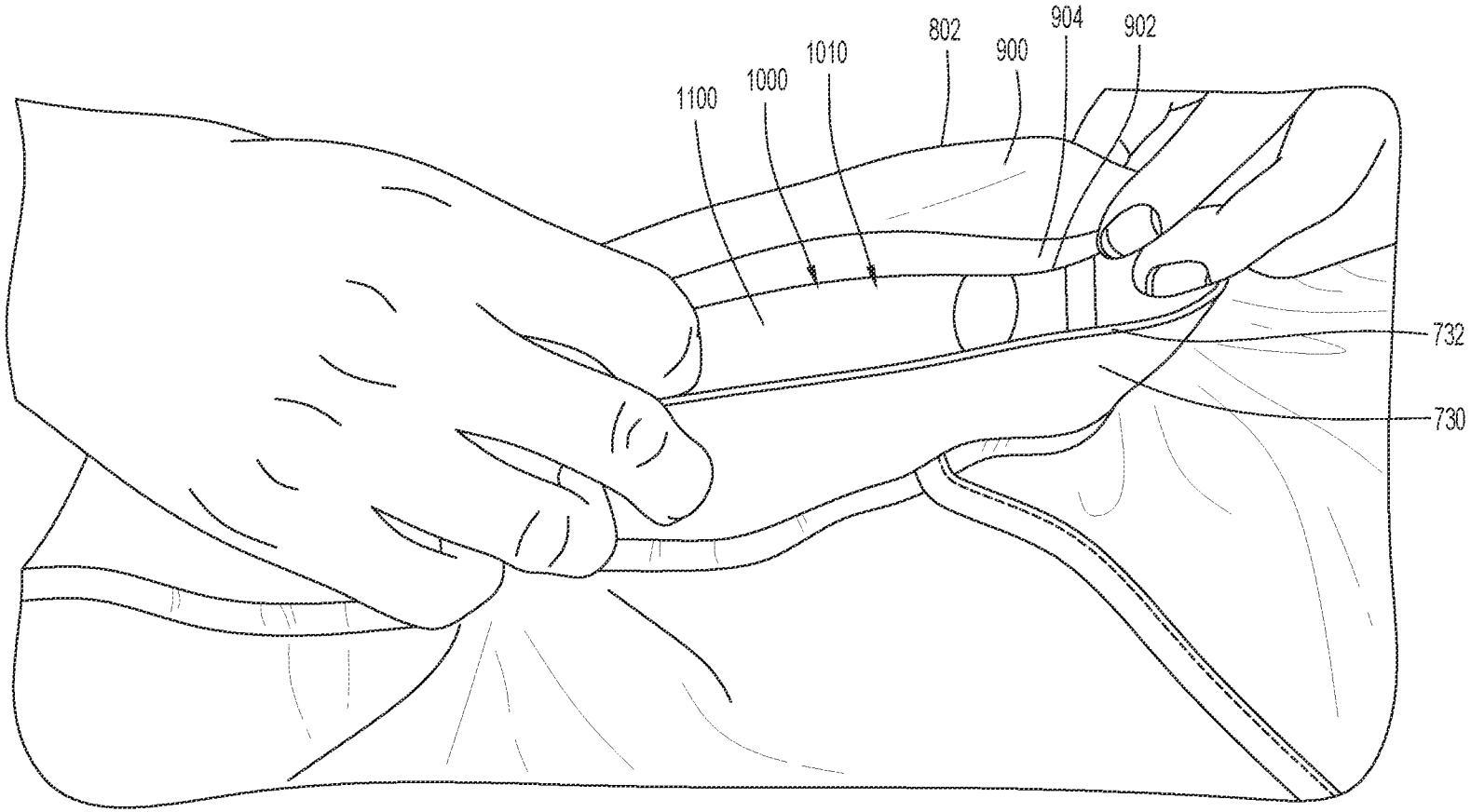
FIG. 11A illustrates a perspective view of the pocket of the embodiment of the garment illustrated in FIG. 7, where an object is being placed within the pocket.
Figure 11B:
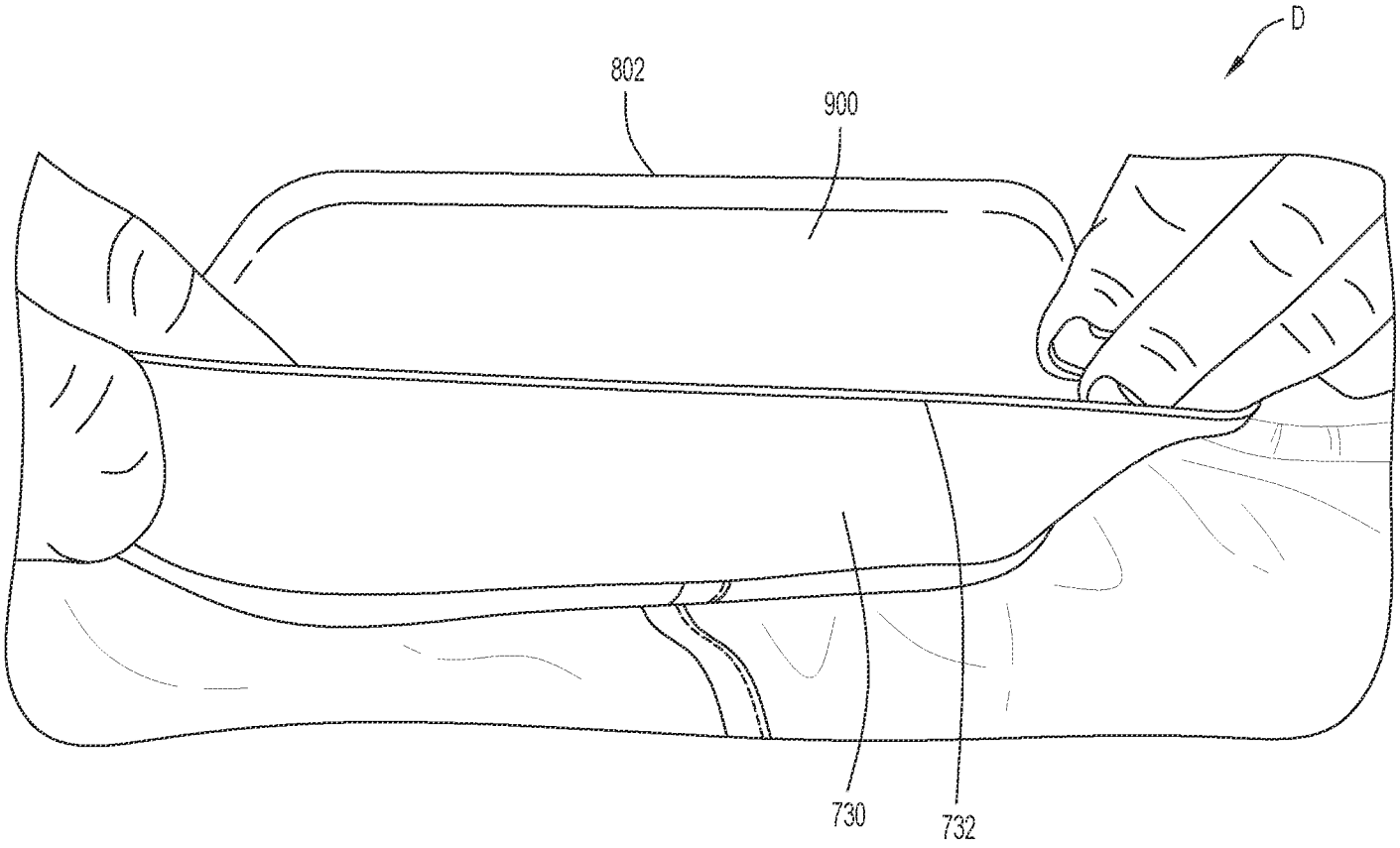
FIG. 11B illustrates a front view of the pocket of the embodiment of the garment illustrated in FIG. 7, where an object is being placed within the pocket.

Once the opening 1000 has been formed between the top edge 802 of the pocket 800 and the top edge 732 of the waist portion 730, an object 1100, such as a mobile electronic device, may be placed within the interior 1010 of the pocket 800 as illustrated in FIGS. 11A and 11B. Once placed within the interior 1010 of the pocket 800, the first unexposed panel 900 may be slipped over the object to place the object 1100 between the first unexposed panel 900 and the other panels 820, 830, 840, 910, 920, 930, 940. As illustrated in FIG. 11A, the bottom edge 902 and the binding 904 of the first unexposed panel 900 are slid over the top of the object 1100 to position the object 1100 between the first unexposed panel 900 and the other panels 820, 830, 840, 910, 920, 930, 940. The longer length L3 of the bottom edge 902 may more easily allow objects to be positioned between the first unexposed panel 900 and the other panels 820, 830, 840, 910, 920, 930, 940. As illustrated in FIG. 11B, once the object is disposed between the first unexposed panel 900 and the other panels 820, 830, 840, 910, 920, 930, 940, the user continues to slide the bottom edge 902 and the binding 904 of the first unexposed panel 900 down the object 1100 causing the other panels 820, 830, 840, 910, 920, 930, 940 of the backing sheet 850 to become at least partially unfolded along the edges/fold lines 822, 824, 832, 834, 912, 922, 942 and increasing the overall height of the pocket 800 (e.g., the distance between the bottom edge 804 and the top edge 802). The sliding of the bottom edge 902 and the binding 904 of the first unexposed panel 900 down the object 1100 causes the pocket 800 to be reconfigured from the empty configuration C to the expanded configuration D. The overall height of the pocket 800 when in the expanded configuration D may vary depending on the size of the object 1100 placed within the interior 1010 of the pocket 800. Therefore, the larger the object 1100 disposed within the pocket 800, the larger the distance between the bottom edge 804 and the top edge 802 of the pocket 800. Moreover, the larger the object 1100 disposed within the pocket 800, the more the panels 820, 830, 840, 910, 920, 930, 940 of the backing sheet 850 become unfolded. In other words, the larger the object 1100, the panels 820, 830, 840, 910, 920, 930, 940 and the fold lines 822, 824, 832, 834, 912, 922, 942 become less visible.

The bottom edge 902 and the binding 904 of the first unexposed panel 900 must be slid down the object 1100 disposed within the interior 1010 of the pocket 800 so that the bottom edge 902 and binding 904 are positioned lower than the top edge 732 of the waist portion 730. This ensures that the object 1100 is secured within the pocket 800 when the pocket 800 is in the expanded configuration D. As further illustrated, sliding the bottom edge 902 and the binding 904 of the first unexposed panel 900 down the object 1100 also raises the top edge 802 of the pocket 800 beyond the top edge 732 of the waist portion 730. The resilient and elastic nature of the panels 820, 830, 840, 900, 910, 920, 930, 940, and/or the binding 904 of the backing sheet 850 secure the object against the interior surface 739 of the waist portion 730. The resilient and elastic nature of the panels 820, 830, 840, 900, 910, 920, 930, 940, and/or the binding 904 of the backing sheet 850 also keeps the first unexposed panel 900 folded over the object 1100 disposed within the pocket 800. Because the first unexposed panel 900 is disposed over the object 1100 such that the bottom edge 902 of the first unexposed panel 900 is oriented lower than the top edge 732 of the waist portion 730, the first unexposed panel 900 serves as a cap, lid, or cover for objects 1100 placed within the interior 1010 of the pocket 800.

Figure 12A:
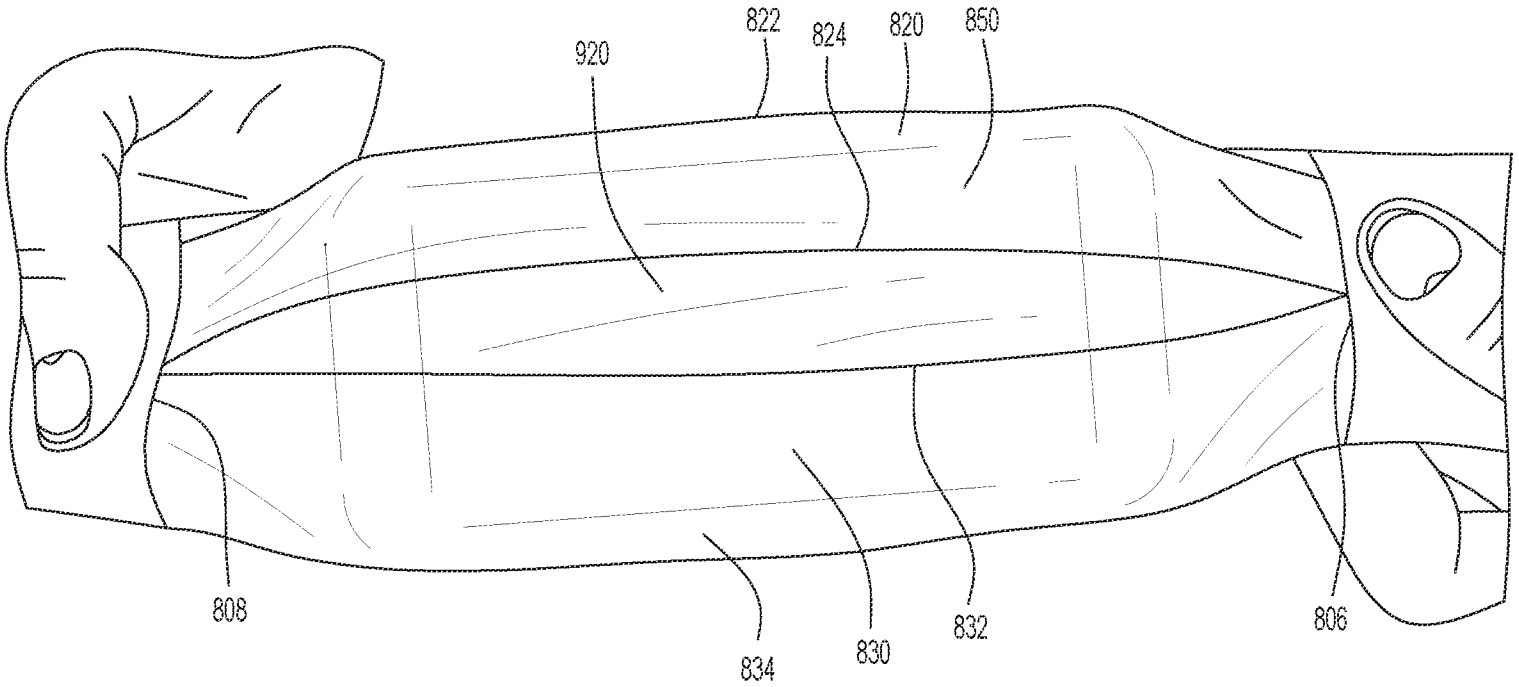
FIG. 12A illustrates a rear view of the pocket of the embodiment of the garment illustrated in FIG. 7, the pocket being in the expanded configuration.
Figure 12B:
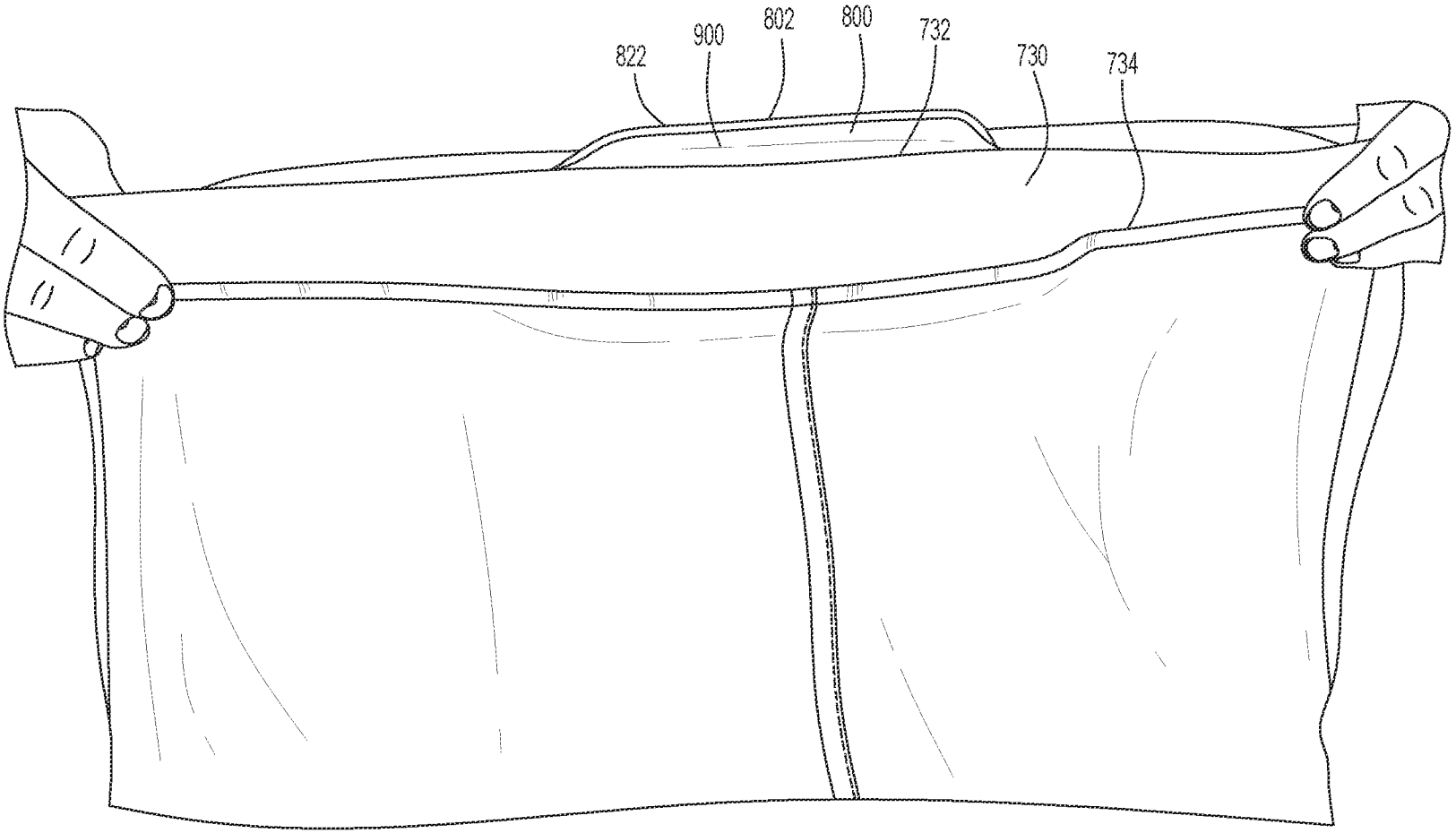
FIG. 12B illustrates a front view of the embodiment of the garment illustrated in FIG. 7, the pocket being in the expanded configuration.

As previously explained, FIGS. 12A and 12B illustrated the pocket 800 in the fully expanded configuration D, where an object 1100 is disposed within the interior 1010 of the pocket 800. As illustrated in FIG. 12A, when in the expanded configuration D, the exposed panels 820, 830, 840 separate from one another, and become at least partially unfolded, causing at least some of the unexposed panels 910, 920, 930, 940 to be visible from the interior of the pants 20. In the embodiment illustrated in FIG. 12A, the object 1100 placed within the interior 1010 of the pocket 800 causes the bottom edge 824 of the first exposed panel 820 to separate from the top edge 832 of the second exposed panel 830 to reveal at least the third unexposed panel 920. FIG. 12A further illustrates how the panels 820, 830, 840, 900, 910, 920, 930, 940 and the fold lines 822, 824, 832, 834, 912, 922, 942 of the backing sheet 850 are bound or coupled to the waist portion 730 at the first side 806 and the second side 808 of the pocket 800. Thus, once the object 1100 is removed from the pocket 800, the backing sheet 850 is returned to its configuration or form when the pocket is in the empty configuration, where the backing sheet 850 contains the panels 820, 830, 840, 900, 910, 920, 930, 940 and the fold lines 822, 824, 832, 834, 912, 922, 942.

FIG. 12B best illustrates how, when the pocket 800 is in the expanded configuration D, the top edge 802 of the pocket 800 is no longer aligned with the top edge 732 of the waist portion 730 and is disposed above the top edge 732 of the waist portion 730.

When the pants 10 and pants 20 are worn by a wearer, the waist portions 130, 730 are stretched and/or deformed outwardly or laterally. More specifically, when the waist portions 130, 730 are stretched and/or deformed laterally, the openings 136, 736 formed by the waist portions 130, 730, respectively, increase in diameter.

With respect to the first embodiment of the pants 10, the lateral stretching of the waist portion 130 causes the first flap 500 to also stretch laterally. Because the first flap 500 is fixedly coupled to the top edge 732 of the waist portion 130 and the first and second sides 506, 508, the lateral stretching of the first flap 500 creates a tension closure over the second flap 510 to secure the pocket 160 closed. Because of the first and second seams 614, the lateral stretching of the waist portion 130 creates opposing tensile forces on the pocket 160, which causes the first flap 500 to press against the second flap 510. In other words, the opposing tensile forces cause the interior surface of the first flap 500 to abut or contact the exterior surface of the second flap 510. As the amount or degree of stretching of the waist portion 130 in the outward or lateral direction increases, the amount of the opposing tensile forces that act on the first flap 500 also increases. Thus, the greater the amount of stretching of the waist portion 130, the stronger the amount of tension in the first flap 500 that keeps the first flap 500 pressed against the second flap 510 to secure items within the pocket 160. In other words, as the lateral load on the waist portion 130 increases, the forces that force the first flap 500 to locks down onto the second flap 510 to secure items within the pocket 160 also increases.

Continuing with the first embodiment of the pants 10, the first and the second flaps 500, 510 and the rear side 600 may together act as an adaptable and dynamic pocket system. Because each of the first and the second flaps 500, 510 and the rear side 600 are constructed from materials with the same or similar degrees of resiliency, the pocket 160 is adaptable to the person wearing the pants 10 and the items stored within the pocket 160 of the pants 10. Because of the resilient nature of the flaps 500, 510 and the rear side 600, as the lateral load on the waist portion 130 increases, the opposing tensile forces on these components 500, 510, 600 also increases, causing these components 500, 510, 600 to stretch laterally. These components 500, 510, 600, however, are configured to stretch simultaneously, or in unison, so that the first flap 500 still serves as a tension closure to the pocket 160. As previously explained, as the amount or degree of stretching of the waist portion 130 in the outward or lateral direction increases, the opposing tensile forces that act on the components 500, 510, 600 also increases.

With respect to the second embodiment of the pants 20, the lateral stretching of the waist portion 730 causes the backing sheet 850 to also stretch laterally. Because the backing sheet 850 is fixedly coupled to the waist portion 730 at the first and second sides 806, 808 of the pocket 800, the lateral stretching of the backing sheet 850 creates a tension closure to secure the pocket 800 closed. More specifically, because of the first and second seams 810 and/or the bar tacks 812, the lateral stretching of the waist portion 730 creates opposing tensile forces on the pocket 800, which causes the first unexposed panel 900 to press against the exposed portion of the backing sheet 850. The opposing tensile forces on the pocket 800 also causes the backing sheet 850, including the first unexposed panel 900, to press against the interior surface 739 of the waist portion 730, which closes the opening 1000. In addition to the tensile forces imparted onto the pocket 800 by the lateral stretching of the waist portion 730, because the backing sheet 850 is disposed on the interior surface 739 of the waist portion 730 (i.e., the side of the waist portion 730 that faces the user wearing the pants 20), when the pants 20 are worn by a user, the user's body presses the backing sheet 850 against the interior surface 739 of the waist portion 730. As the amount or degree of stretching of the waist portion 730 in the outward or lateral direction increases, the amount of the opposing tensile forces that act on the first unexposed panel 900 and the remaining portions of the backing sheet 850 also increases. Thus, the greater the amount of stretching of the waist portion 730, the stronger the amount of tension in the first unexposed panel 900 that keeps the first unexposed panel 900 pressed against the remaining portions of the backing sheet 850 to secure items within the pocket 800.

The backing sheet 850 acts together with the waist portion 730 as an adaptable and dynamic pocket system. Because the backing sheet 850 and the waist portion 730 are constructed from materials with the same or similar degrees of resiliency, the pocket 800 is adaptable to the person wearing the pants 20 and the items stored within the pocket 800 of the pants 20. Because of the resilient nature of the backing sheet 850 and the waist portion 730, as the lateral load on the waist portion 730 increases, the opposing tensile forces on backing sheet 850 also increases, causing backing sheet 850 to stretch laterally. The backing sheet 850, however, is configured to stretch simultaneously, or in unison, with the waist portion 730 so that the first unexposed panel 900 and the remaining portions of the backing sheet 850 still serve as a closure to the pocket 800. As previously explained, as the amount or degree of stretching of the waist portion 730 in the outward or lateral direction increases, the opposing tensile forces that act on the backing sheet 850 also increases.

With the pockets 160, 800 being disposed on the front side 100, 700 of pants 10, 20, respectively, the pockets 160, 800 are easily accessible by users wearing the pants 10, 20. Thus, users may easily secure objects 1100 within the pockets 160, 800 while wearing the pants 10, 20 and performing activities (e.g., running, playing sports, working out, etc.). It then follows that objects disposed within the pockets 160, 800 are also easily accessed by users wearing the pants 10, 20 while also performing activities.

While the invention has been described in detail and with reference to specific embodiments thereof, it will be apparent to one skilled in the art that various changes and modifications can be made therein without departing from the spirit and scope thereof.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A method of storing an object in a garment including a waistband pocket, the method comprising:

obtaining the garment including:

a waistband defining an interior, user-facing surface and an opposite, exterior surface, the waistband including a top edge and a bottom edge, a leg portion coupled to the bottom edge of the waistband, and a dynamic pocket comprising a resilient sheet coupled to the interior surface of the waistband such that a pocket cavity is defined between the resilient sheet and the interior surface of the waistband, the resilient sheet comprising a first end and an opposite second end, the second end forming a bottom edge of the resilient sheet and the bottom edge of the resilient sheet being coupled to the waistband, the resilient sheet comprising a plurality of panels folded along a plurality of fold lines disposed between the first end and the second end, a first fold line of the plurality of fold lines forming a top edge of the resilient sheet such that the first end of the resilient sheet is disposed within the pocket cavity, the dynamic pocket further comprising an opening defined between the top edge of the resilient sheet and the top edge of the waistband, wherein the plurality of panels are configured to unfold along the plurality of fold lines to increase a height of the resilient sheet;

unfolding the plurality of panels to increase the height of the resilient sheet; and inserting the object into the pocket cavity.

2. The method according to claim 1, wherein the resilient sheet includes an end panel defined between the first fold line of the plurality of fold lines and the first end of the resilient sheet, the end panel being folded onto the resilient sheet such that the end panel is positioned within the pocket cavity.

3. The method according to claim 2, wherein the method further comprises positioning the object between the end panel and the resilient sheet.

4. The method according to claim 3, wherein:

the resilient sheet further includes a binding located along the first end of the resilient sheet; and positioning the object further comprises sliding the first end of the resilient sheet including the binding along the object.

5. The method according to claim 1, wherein:

the plurality of panels are configured to unfold along the plurality of fold lines to increase the height of the resilient sheet beyond the top edge of the waistband; and the method further comprises unfolding the plurality of panels to increase the height of the resilient sheet beyond the top edge of the waistband.

6. The method according to claim 1, wherein the method further comprises unfolding the plurality of panels to increase the height of the top edge of the resilient sheet beyond the top edge of the waistband.

7. The method according to claim 1, wherein the second end of the resilient sheet is coupled to the bottom edge of the waistband.

8. The method according to claim 1, wherein the second end of the resilient sheet is coupled to the interior surface of the waistband proximate to the bottom edge of the waistband.

9. The method according to claim 1, wherein the first end of the resilient sheet has a first length and the second end of the resilient sheet has a second length, the first length being greater than the second length.

10. A method of storing an object in a garment including a waistband pocket, the method comprising: donning the garment including:

a waistband defining an interior, user-facing surface and an opposite, exterior surface, the waistband including a top edge and a bottom edge, a leg portion coupled to the bottom edge of the waistband, and the waistband pocket being disposed on the interior surface of the waistband, the waistband pocket comprising a resilient sheet secured to the waistband to define a pocket interior between the interior surface of the waistband and the resilient sheet, the resilient sheet including a first end and an opposite second end, the second end forming a bottom edge of the resilient sheet and the bottom edge of the resilient sheet being coupled to the waistband, the resilient sheet further comprising a fold line defining an end panel between the fold line and the first end of the resilient sheet, the fold line forming a top edge of the resilient sheet such that the end panel forms a lid configured to cover the object, the end panel being at least partially disposed within the pocket interior;

inserting the object into the pocket interior; and positioning the object between the end panel and the resilient sheet such that the object is covered by the lid;

wherein the resilient sheet comprises a plurality of panels folded along a plurality of fold lines;

the plurality of panels are configured to unfold along the plurality of fold lines to increase a height of the resilient sheet; and the method comprises unfolding the plurality of panels along the plurality of fold lines to increase the height of the resilient sheet.

11. The method according to claim 10, wherein:

the resilient sheet comprises a plurality of folds;

the resilient sheet is configured to unfold from a first configuration, in which the top edge of the resilient sheet is positioned proximate with a waistband top edge, to a second configuration, in which the top edge of the resilient sheet extends beyond the waistband top edge; and the method further comprises unfolding the resilient sheet from the first configuration to the second configuration.

12. The method according to claim 10, wherein:

the end panel includes a binding located along the first end of the resilient sheet; and positioning the object further comprises sliding the first end of the resilient sheet including the binding along the object.

13. The method according to claim 10, wherein the bottom edge of the resilient sheet is secured to the bottom edge of the waistband via stitching, the resilient sheet further includes:

a first lateral side and a second lateral side; and each of the first lateral side and the second lateral side is secured to the waistband via stitching.

14. The method according to claim 10, wherein:

each fold line layers a first panel of the plurality of panels over a second panel of the plurality of panels; and insertion of the object into the pocket interior unfolds the resilient sheet.

15. The method according to claim 10, wherein:

the resilient sheet is configured to apply increasing tension to the object as a load on the waistband increases; and the method further comprises applying the load on the waistband.

16. The method according to claim 10, wherein the second end of the resilient sheet is coupled to the interior surface of the waistband proximate to the bottom edge of the waistband.

17. A method of storing an object in a garment including a waistband pocket, the method comprising:

obtaining the garment, the garment including:

an interior, user facing surface and an opposite, exterior surface, a waistband including a top edge and a bottom edge, a leg portion coupled to the bottom edge of the waistband, and a dynamic pocket comprising a resilient sheet disposed on the interior surface of the garment proximate to the waistband such that a pocket cavity is defined between the resilient sheet and the waistband, the resilient sheet comprising a first end and an opposite second end spaced from the first end, the second end forming a bottom edge of the resilient sheet and the bottom edge of the resilient sheet being coupled to the interior surface of the garment, the resilient sheet including a plurality of panels folded along a plurality of fold lines, at least one of the fold lines defining a top edge of the resilient sheet, the dynamic pocket further comprising an opening defined between a top edge of the resilient sheet and the top edge of the waistband, wherein the plurality of panels are configured to unfold along the plurality of fold lines to increase a height of the resilient sheet;

unfolding the plurality of panels to increase the height of the resilient sheet; and inserting the object into the pocket cavity.

18. The method of claim 17, wherein the bottom edge of the resilient sheet is coupled to the bottom edge of the waistband.

19. The method of claim 17, wherein the bottom edge of the resilient sheet is coupled to the interior surface of the garment proximate to the bottom edge of the waistband.

* * * * *